US009791160B2

(12) United States Patent
Yamaguchi et al.

(10) Patent No.: US 9,791,160 B2
(45) Date of Patent: Oct. 17, 2017

(54) FLOOR-POSITIONED AIR-CONDITIONING APPARATUS

(71) Applicants: Kouji Yamaguchi, Tokyo (JP); Hideyuki Ogata, Tokyo (JP); Takashi Ikeda, Tokyo (JP); Masatomo Hatta, Tokyo (JP); Keichi Ochiai, Tokyo (JP); Tetsuo Yamashita, Tokyo (JP); Tetsuya Tazawa, Tokyo (JP); Keisuke Tomomura, Tokyo (JP); Toshiya Yamauchi, Tokyo (JP)

(72) Inventors: Kouji Yamaguchi, Tokyo (JP); Hideyuki Ogata, Tokyo (JP); Takashi Ikeda, Tokyo (JP); Masatomo Hatta, Tokyo (JP); Keichi Ochiai, Tokyo (JP); Tetsuo Yamashita, Tokyo (JP); Tetsuya Tazawa, Tokyo (JP); Keisuke Tomomura, Tokyo (JP); Toshiya Yamauchi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 495 days.

(21) Appl. No.: 14/370,545

(22) PCT Filed: Feb. 14, 2013

(86) PCT No.: PCT/JP2013/053578
§ 371 (c)(1),
(2) Date: Jul. 3, 2014

(87) PCT Pub. No.: WO2013/129123
PCT Pub. Date: Sep. 6, 2013

(65) Prior Publication Data

US 2014/0367069 A1 Dec. 18, 2014

(30) Foreign Application Priority Data

Mar. 1, 2012 (JP) ..... 2012-045259

(51) Int. Cl.
*F25B 29/00* (2006.01)
*G05D 23/00* (2006.01)
(Continued)

(52) U.S. Cl.
CPC ..... *F24F 7/10* (2013.01); *F24F 1/0007* (2013.01); *F24F 1/0011* (2013.01); *F24F 3/00* (2013.01);
(Continued)

(58) Field of Classification Search
CPC ..... F24F 11/0078; F24F 13/14; F24F 1/0007; F24F 1/0011; F24F 2001/004;
(Continued)

(56) References Cited

U.S. PATENT DOCUMENTS 4,995,426 A * 2/1991 Hinden ..... F16L 43/003 138/39
5,738,580 A * 4/1998 Baek ..... F24F 13/075 454/153
(Continued)

FOREIGN PATENT DOCUMENTS

JP 43-11347 5/1968
JP 60-228843 A 11/1985
(Continued)

OTHER PUBLICATIONS

Extended European Search Report issued Nov. 19, 2015 in the corresponding EP application No. 13754562.0.
(Continued)

*Primary Examiner* — Judy Swann
*Assistant Examiner* — Jason Thompson
(74) *Attorney, Agent, or Firm* — Posz Law Group, PLC

(57) ABSTRACT

A floor-positioned air-conditioning apparatus including a housing including a fan and a heat exchanger; a forward blowing control member rotatably arranged at a forward air
(Continued)

outlet formed in a housing front surface at a position near a housing top surface; and an upward blowing control member rotatably arranged at an upward air outlet formed near the housing front surface are included. The forward blowing control member closes the forward air outlet and the upward blowing control member closes the upward air outlet during operation stop. The forward blowing control member closes the forward air outlet and the upward blowing control member is rotated and opens the upward air outlet during cooling operation. The upward blowing control member closes the upward air outlet and the forward blowing control member is rotated and opens the forward air outlet during heating operation.

14 Claims, 21 Drawing Sheets

(51) Int. Cl.

| | |
|---|---|
| ***F24F 7/10*** | (2006.01) |
| ***F24F 13/14*** | (2006.01) |
| ***F24F 1/00*** | (2011.01) |
| ***F24F 11/00*** | (2006.01) |
| ***F24F 3/00*** | (2006.01) |
| ***F24F 7/007*** | (2006.01) |

(52) U.S. Cl.
CPC ..... *F24F 7/007* (2013.01); *F24F 11/0078* (2013.01); *F24F 13/14* (2013.01); *F24F 2001/004* (2013.01)

(58) Field of Classification Search
CPC ..... F24F 7/007; F24F 1/0014; F24F 13/1413; F24F 2013/1433; F24F 2013/1446; F24F 13/15; F24F 13/08; F24F 13/081; F28D 2021/0035; H01L 23/4334
USPC ..... 165/249, 254, 259, 300
See application file for complete search history.

(56) References Cited

U.S. PATENT DOCUMENTS

| | | | | |
|---|---|---|---|---|
| 5,873,780 | A * | 2/1999 | Mori | F24F 1/0011 454/285 |
| 2004/0007002 | A1* | 1/2004 | Asami | F24F 1/0011 62/186 |
| 2010/0319901 | A1* | 12/2010 | Agarwal | F24F 5/0096 165/253 |

FOREIGN PATENT DOCUMENTS

| | | | | |
|---|---|---|---|---|
| JP | 02-057856 | A | | 2/1990 |
| JP | 04-19394 | Y2 | | 5/1992 |
| JP | 06-5525 | Y2 | | 2/1994 |
| JP | 2005-164067 | A | | 6/2005 |
| JP | 2005164067 | A | * | 6/2005 |
| JP | 2010-091260 | A | | 4/2010 |
| JP | 2011-237058 | A | | 11/2011 |
| JP | 2011237058 | A | * | 11/2011 |

OTHER PUBLICATIONS

First Examination Report dated Mar. 10, 2015 issued in corresponding NZ patent application No. 627031.
International Search Report of the International Searching Authority mailed Apr. 16, 2013 for the corresponding international application No. PCT/JP2013/053578 (and English translation).
Office Action issued Jun. 3, 2016 in the corresponding CN patent application No. 201380010391.9 (with English translation).
Office Action mailed Oct. 6, 2015 in the corresponding JP application No. 2014-502125 (with English translation).

* cited by examiner

FLOOR-POSITIONED AIR-CONDITIONING APPARATUS

CROSS REFERENCE TO RELATED APPLICATION

This application is a U.S. national stage application of PCT/JP2013/053578 filed on Feb. 14, 2013, and is based on Japanese Patent Application No. 2012-045259 filed on Mar. 1, 2012, the contents of which are incorporated herein by reference.

TECHNICAL FIELD

The present invention relates to floor-positioned air-conditioning apparatuses, and more particularly to a floor-positioned air-conditioning apparatus including an air-direction control mechanism that can control each of a blowing direction of cooled air and a blowing direction of heated air.

BACKGROUND

There is disclosed a conventional floor-positioned air-conditioning apparatus that blows heated air forward (hereinafter, referred to as "forward blowing") and blows cooled air upward (hereinafter, referred to as "upward blowing"), and that includes an air-direction control mechanism, in which, for example, an air-direction change plate having a substantially arcuate cross section and a decorative plate having a flat surface are coupled together by a link mechanism, and each of the plates can be rotated (for example, see Patent Literature 1).

PATENT LITERATURE

Patent Literature 1: Japanese Examined Utility Model Registration Application Publication No. 4-19394 (Page 5, FIGS. 4 and 5)

In the air-direction control mechanism disclosed in Patent Literature 1, during forward blowing, the air-direction change plate is substantially horizontal and the decorative plate is horizontal to form a forward blowing passage, and during upward blowing, the air-direction change plate and the decorative plate are substantially vertical to form an upward blowing passage. Hence, the following problems arise.

(a) The decorative plate substantially closes the upper side during forward blowing and substantially closes the front side during upward blowing. However, during operation stop, since one of the upper side and the front side is open (the blowing passage is continuously formed at the upper side or the front side), design may be degraded, and dust and a foreign substance may enter the inside. Also, even if design is made by dimensions without a gap on the design drawing, a gap may be generated because of member molding accuracy and assembling accuracy.

(b) In addition, although forward blowing can be provided, conditioned air cannot be blown downward during operation.

SUMMARY

The invention is made to address the above-described problems, and a first object is to provide a floor-positioned air-conditioning apparatus that can close both a blown air passage during forward blowing and a blown air passage during upward blowing, during operation stop.

Also, a second object is to provide a floor-positioned air-conditioning apparatus that can blow conditioned air downward during operation.

Further, a third object is to provide a floor-positioned air-conditioning apparatus that can control the direction of blown air.

A floor-positioned air-conditioning apparatus according to the invention includes a housing including a fan and a heat exchanger that can selectively execute cooling operation and heating operation; a forward blowing control member rotatably arranged at a forward air outlet formed in a front surface of the housing at a position near a top surface of the housing; and an upward blowing control member rotatably arranged at an upward air outlet formed in the top surface of the housing at a position near the front surface of the housing. The forward blowing control member closes the forward air outlet and the upward blowing control member closes the upward air outlet during operation stop. The forward blowing control member closes the forward air outlet and the upward blowing control member is rotated and opens the upward air outlet during cooling operation. The upward blowing control member closes the upward air outlet and the forward blowing control member is rotated and opens the forward air outlet during heating operation.

With the floor-positioned air-conditioning apparatus according to the invention, since both the forward air outlet and the upward air outlet can be closed during operation stop, apparent design can be ensured, and dust and a foreign substance can be prevented from entering the inside.

DETAILED DESCRIPTION

Embodiment 1: Floor-positioned Air-conditioning Apparatus

Figure 1:
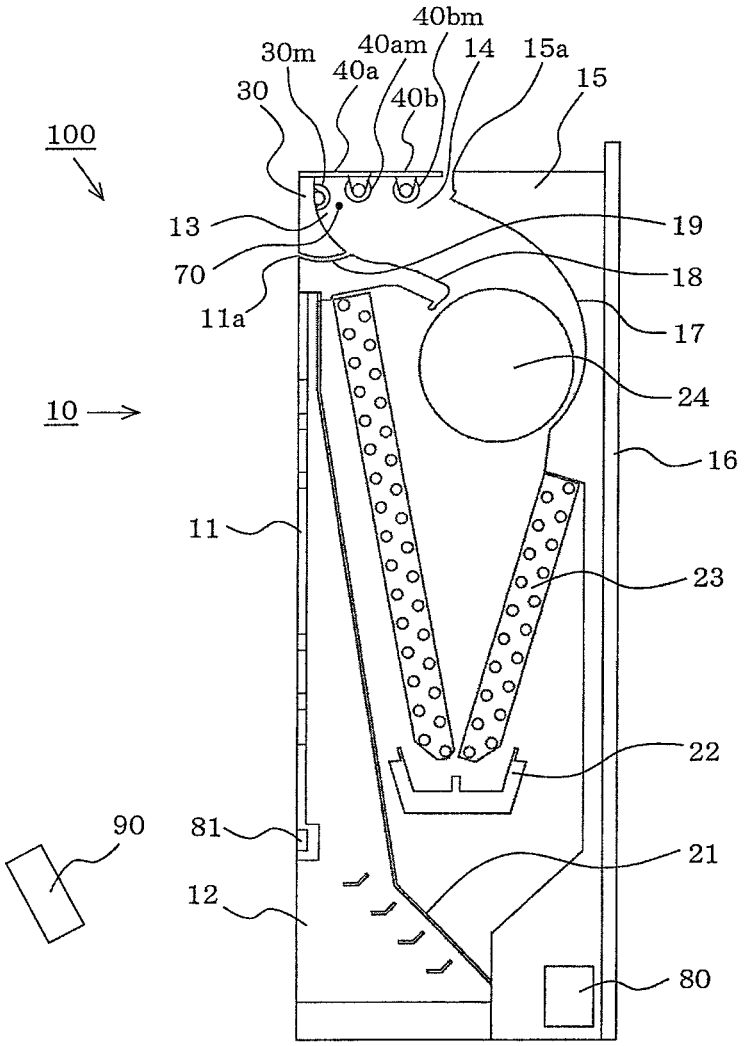
FIG. 1 is a cross-sectional view generally showing a floor-positioned air-conditioning apparatus according to Embodiment 1 of the invention.
Figure 2:
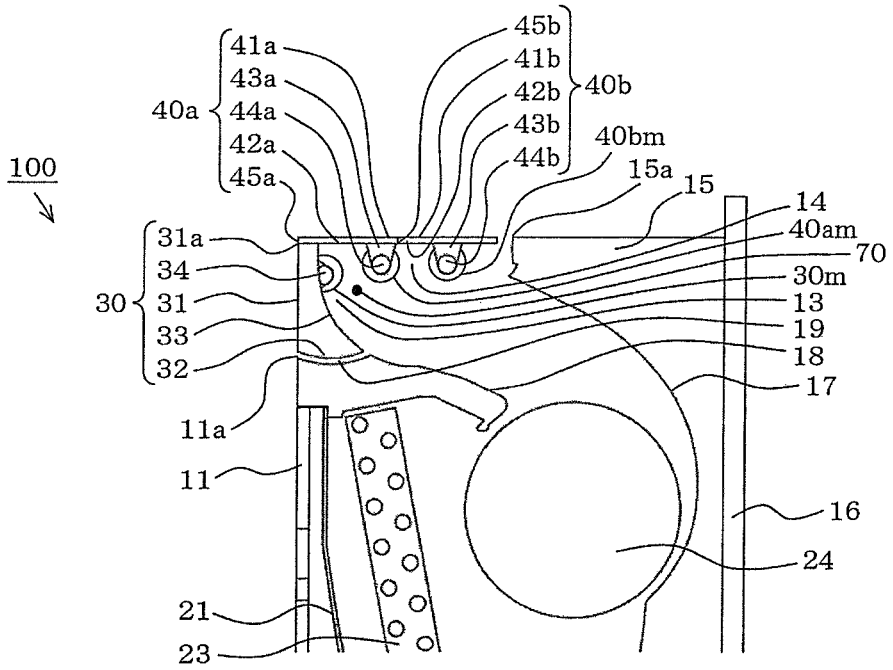
FIG. 2 is a cross-sectional view showing, in during operation stop, an air-direction control mechanism of the floor-positioned air-conditioning apparatus shown in FIG. 1.
Figure 3:
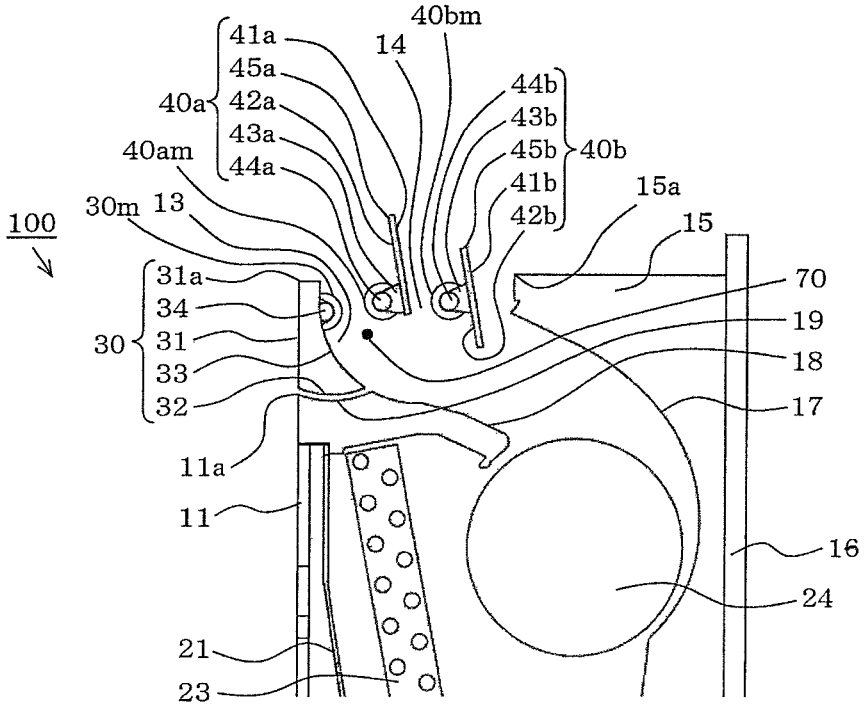
FIG. 3 is a cross-sectional view showing the air-direction control mechanism during cooling operation of the floor-positioned air-conditioning apparatus shown in FIG. 1.
Figure 4:
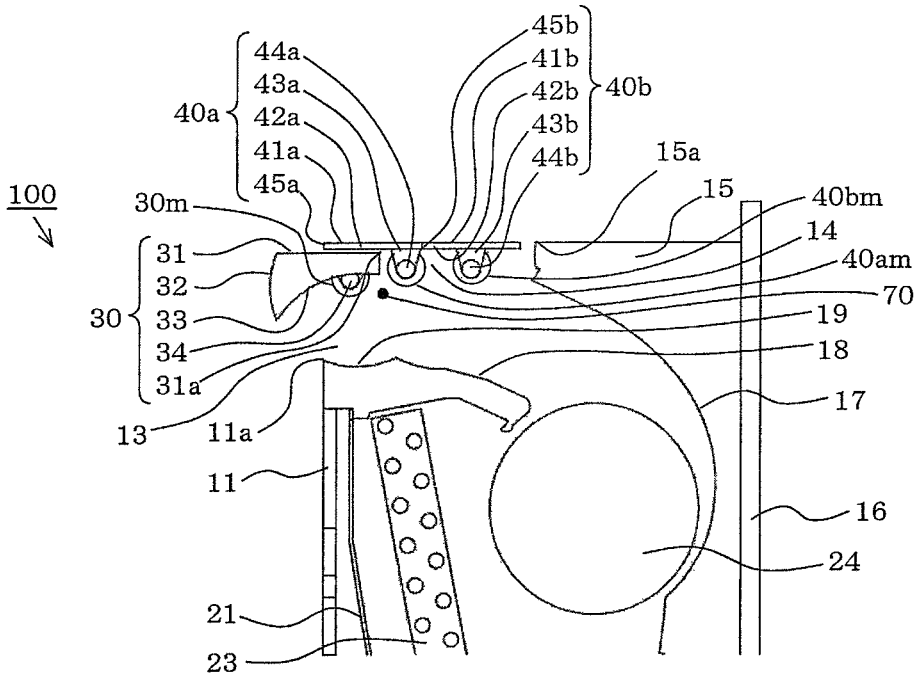
FIG. 4 is a cross-sectional view showing the air-direction control mechanism during heating operation of the floor-positioned air-conditioning apparatus shown in FIG. 1.
Figure 5:
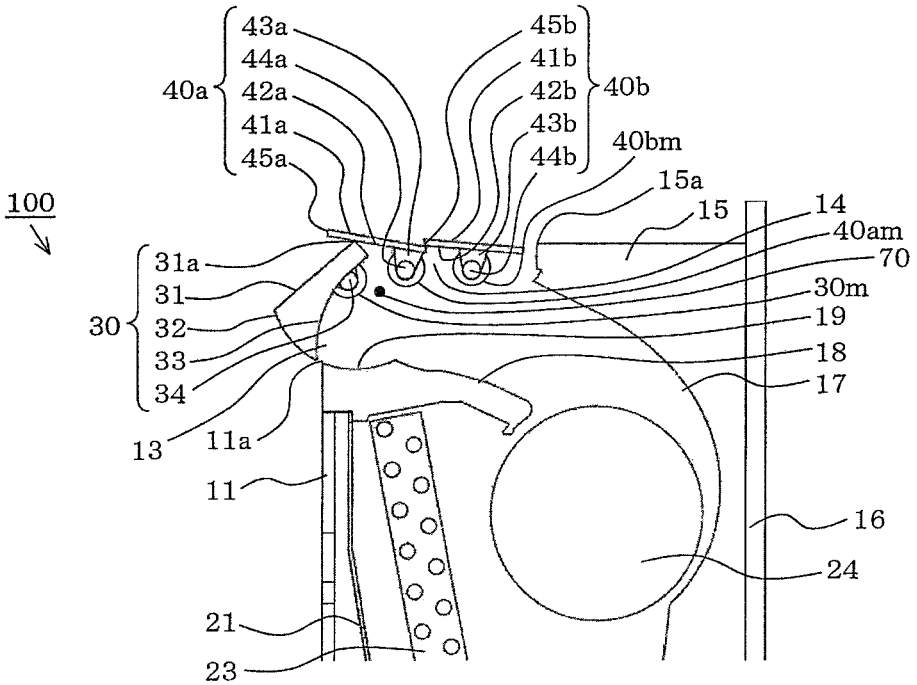
FIG. 5 is a cross-sectional view showing operation of the air-direction control mechanism of the floor-positioned air-conditioning apparatus shown in FIG. 1.
Figure 6:
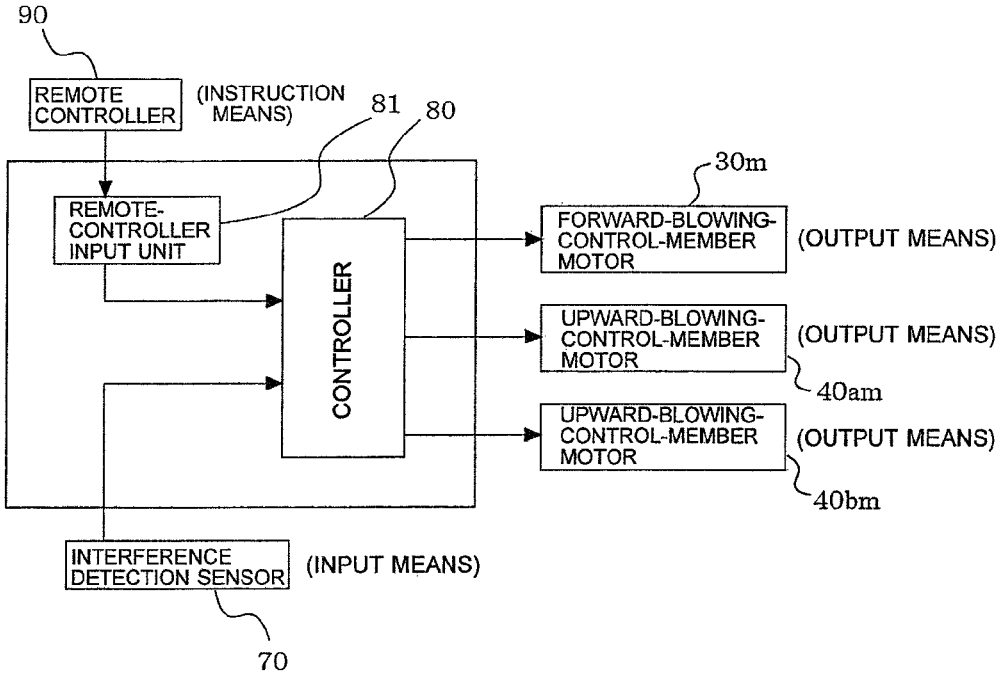
FIG. 6 is a block diagram explaining a control system of the floor-positioned air-conditioning apparatus shown in FIG. 1.
Figure 7:
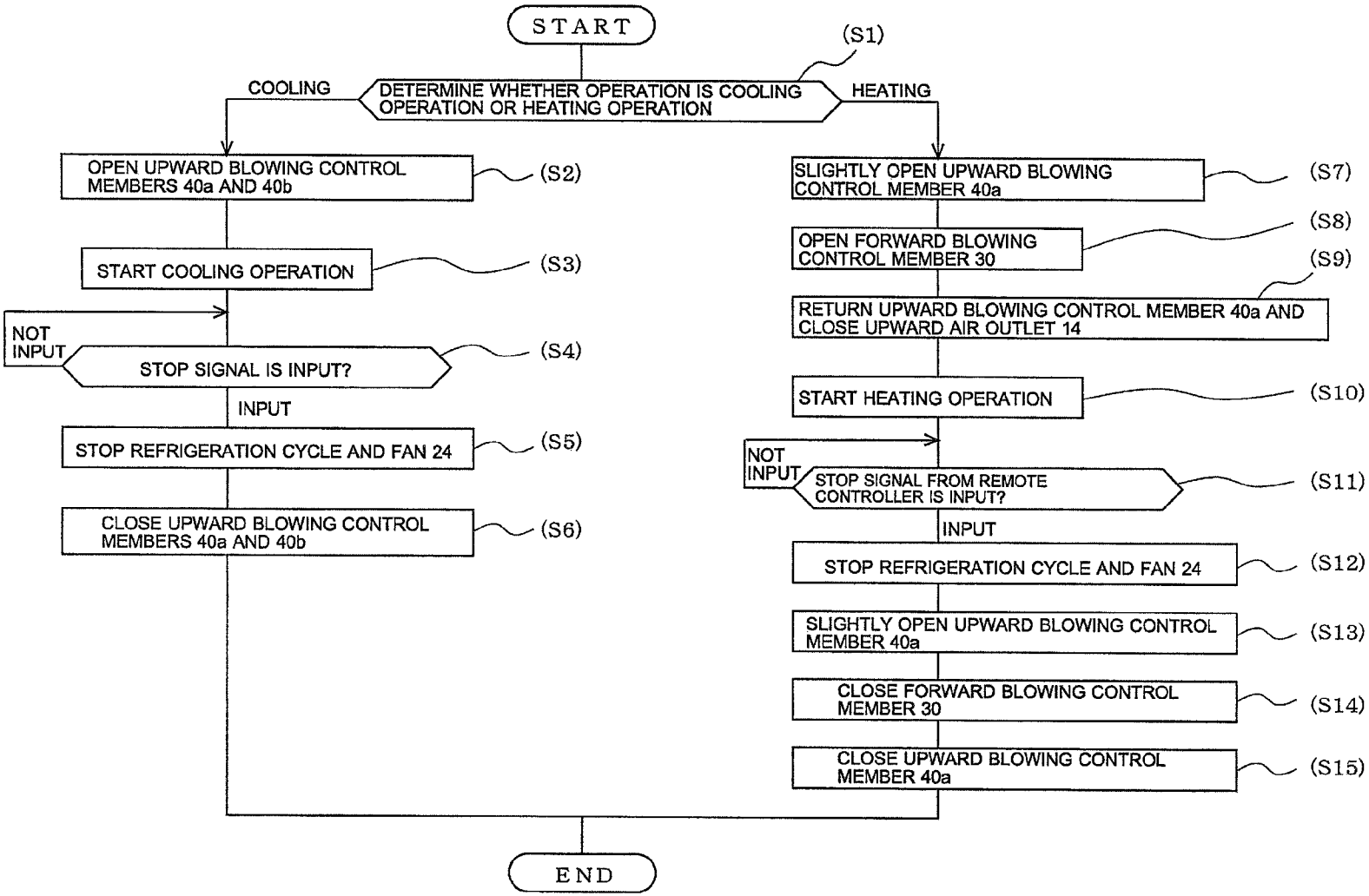
FIG. 7 is a flowchart explaining the control system of the floor-positioned air-conditioning apparatus shown in FIG. 1.

FIGS. 1 to 7 schematically explain a floor-positioned air-conditioning apparatus according to Embodiment 1 of the invention. FIG. 1 is a cross-sectional view generally showing the apparatus. FIG. 2 is a cross-sectional view showing an air-direction control mechanism during operation stop. FIG. 3 is a cross-sectional view showing the air-direction control mechanism during cooling operation. FIG. 4 is a cross-sectional view showing the air-direction control mechanism during heating operation. FIG. 5 is a cross-sectional view showing operation of the air-direction control mechanism. FIG. 6 is a block diagram explaining a control system. FIG. 7 is a flowchart explaining the control system. The respective drawings are schematically drawn. The invention is not limited to Embodiment 1.

In FIG. 1, a floor-positioned air-conditioning apparatus 100 includes a housing 10, a heat exchanger 23 having a substantially V-like shape in side view and arranged in the housing 10, and a fan 24 arranged above the heat exchanger 23 (approximate pocket portion of the substantially V-like shape).

A front-surface opening 12 is formed in a housing front surface 11 of the housing 10. The front-surface opening 12 functions as an "air inlet" for sucking the air. Also, a forward air outlet 13 is formed above the housing front surface 11. A housing top surface 15 is arranged near a housing back surface 16 of the housing 10. An upward air outlet 14 is formed in the housing top surface 15 in an area near the forward air outlet 13.

Further, the housing 10 is provided with a casing back surface 17 and a casing center surface 18. The casing back surface 17 is formed by a smooth curve extending from a position at a housing-back-surface-16 side of the fan 24 to a top-surface front end 15*a*, which is an end portion of the housing top surface 15 at a position near the upward air outlet 14. The casing center surface 18 extends from a position at a slightly obliquely front side of the fan 24 to a front-surface upper end 11*a*, which is an end portion of the housing front surface 11 at a position near the forward air outlet 13.

A filter 21 is arranged between the housing front surface 11 and the heat exchanger 23. A drain receiver 22 is provided below the heat exchanger 23.

Also, a remote-controller input unit 81 is provided at the front surface of the housing 10. A signal emitted from a remote controller 90 (equivalent to instruction means) is input to a controller 80 through the remote-controller input unit 81 (described later in detail).

(Air-Direction Control Mechanism)

In FIG. 2, a forward blowing control member 30 is rotatably provided at the forward air outlet 13, and an upward blowing control member 40*a* and an upward blowing control member 40*b* are rotatably provided at the upward air outlet 14. That is, the forward blowing control member 30, the upward blowing control member 40*a*, and the upward blowing control member 40*b*; and a forward-blowing-control-member motor 30*m*, an upward-blowing-control-member motor 40*am*, and an upward-blowing-control-member motor 40*bm*, which rotate the respective members form the "air-direction control mechanism."

Also, an interference detection sensor (input means) 70 is provided. The interference detection sensor 70 detects approach at a close distance or contact with respect to an upward-inner-surface front end 45*a*, which is an edge of an upward-blowing-control-member inner surface 42*a* at a housing-front-surface-11 side. The interference detection sensor 70 is not limited to the sensor that directly detects the approach or contact, and may be a sensor that makes indirect detection at a position separated from the upward-inner-surface front end 45*a*. The position of the interference detection sensor 70 is not limited to the position shown in FIGS. 1 to 5.

The upward blowing control member 40*a* and the upward blowing control member 40*b* have similar configurations. Therefore, in the following description, indices "a" and "b" applied to reference signs are omitted for configurations included in these members (for example, upward-blowing-control-member outer surface 41*a*, upward-blowing-control-member outer surface 41*b*, and other configurations).

Also, the floor-positioned air-conditioning apparatus 100 includes the upward blowing control member 40*a* and the upward blowing control member 40*b*; however, the invention does not limit the number of upward blowing control members. The upward blowing control member 40*a* may close the entire region of the upward air outlet 14 and the upward blowing control member 40*b* may be omitted. Alternatively, one, or two or more upward blowing control members with similar configurations may be provided in addition to the upward blowing control member 40*a* and the upward blowing control member 40*b*.

(Forward Blowing Control Member)

The forward blowing control member 30 includes a forward-blowing-control-member outer surface 31 having an approximate right triangle shape or an approximate sector shape in side view and being a flat surface continued to the housing front surface 11 during operation stop (the forward-blowing-control-member outer surface 31 may not be continued to the housing front surface 11 by rotation during operation (described later)); a forward-blowing-control-member bottom surface 32 being substantially orthogonal to the forward-blowing-control-member outer surface 31 and having an arcuate cross section; and a forward-blowing-control-member inner surface 33 corresponding to an oblique surface of the approximate right triangle shape and being a curved surface (substantially arcuate cross section) continued to the casing center surface 18 during operation stop.

A forward-blowing-control-member support 34 is provided at the forward-blowing-control-member inner surface 33 of the forward blowing control member 30. The forward blowing control member 30 is provided at the housing 10 rotatably about the forward-blowing-control-member support 34, and is rotated by the forward-blowing-control-member motor 30*m*.

(Upward Blowing Control Member)

The upward blowing control member 40 includes an upward-blowing-control-member outer surface 41 being a flat surface continued to the housing top surface 15 during operation stop (the upward-blowing-control-member outer surface 41 may not be continued to the housing top surface 15 by rotation during operation (described later)); an upward-blowing-control-member inner surface 42 being parallel to the upward-blowing-control-member outer surface 41; an upward-blowing-control-plate arm 43 provided to protrude from the upward-blowing-control-member inner surface 42; and an upward-blowing-control-member support 44 provided at a distal end of the upward-blowing-control-plate arm 43.

The upward blowing control member 40 is provided at the housing 10 rotatably about the upward-blowing-control-member support 44, and is rotated by the upward-blowing-control-member motor 40*m*.

(During Operation Stop)

As described above, during operation stop, the forward blowing control member 30 closes the forward air outlet 13 while the forward-blowing-control-member outer surface 31 is continued to the housing front surface 11, and the upward blowing control member 40 closes the upward air outlet 14 while the upward-blowing-control-member outer surface 41 is continued to the housing top surface 15.

At this time, a forward outer-surface upper end 31*a*, which is an upper edge of the forward-blowing-control-member outer surface 31 substantially contacts an upward inner-surface front end 45*a*, which is an edge of the upward-blowing-control-member inner surface 42*a* at a housing-front-end-11 side.

Hence, during operation stop, both the forward air outlet 13 (air passage during forward blowing) and the upward air outlet 14 (air passage during upward blowing) can be closed. Accordingly, apparent design of the floor-positioned air-conditioning apparatus 100 is prevented from being degraded, and dust and a foreign substance are prevented from entering the housing 10.

(During Cooling Operation)

In FIG. 3, during cooling operation, the upward blowing control member 40 opens the upward air outlet 14, and the forward blowing control member 30 closes the forward air outlet 13. The air (cooled air) passing through the fan 24 is blown upward from the upward air outlet 14. Since the tilt angle of the upward blowing control member 40 can be properly set, the blowing direction of the cooled air can be properly controlled.

At this time, the forward-blowing-control-member inner surface 33 of the forward blowing control member 30 is continued to the casing center surface 18. Hence, an air passage is formed. The air passage is surrounded by a curved surface (having a substantially arcuate cross section) formed by the forward-blowing-control-member inner surface 33 and the casing center surface 18, and the casing back surface 17 facing the curved surface. The air passage extends from the fan 24 to the upward air outlet 14.

Hence, the cooled air is smoothly guided through the air passage, and then the blowing direction is controlled to be in a predetermined direction by the upward blowing control member 40. Accordingly, turbulence of blown air can be suppressed.

Also, a casing front surface 19 continued to the casing center surface 18 and formed at the housing-front-surface-11 side has an arcuate cross section, and faces the forward-blowing-control-member bottom surface 32 having the arcuate cross section with a small gap arranged therebetween. Hence, when the cooled air is guided, the quantity of cooled air that is blown between the casing front surface 19 and the forward-blowing-control-member bottom surface 32 is minimized.

(During Heating Operation)

In FIG. 4, during heating operation, the upward blowing control member 40 closes the upward air outlet 14, and the forward blowing control member 30 opens the forward air outlet 13. The air (heated air) passing through the fan 24 is blown forward from the forward air outlet 13.

At this time, the forward-blowing-control-member outer surface 31 of the forward blowing control member 30 is parallel to the upward-blowing-control-member inner surface 42 of the upward blowing control member 40, and substantially contacts the upward-blowing-control-member inner surface 42. Hence, a substantially smoothly continuous curved surface (hereinafter, referred to as "upper curved surface") is formed by the casing back surface 17, the upward-blowing-control-member inner surface 42, and the forward-blowing-control-member inner surface 33. Also, a continuous curved surface (hereinafter, referred to as "lower curved surface") is formed by the casing center surface 18 and the casing front surface 19. Accordingly, an air passage surrounded by the upper curved surface and the lower curved surface and extending from the fan 24 to the forward air outlet 13 is formed.

Therefore, the heated air is smoothly guided through the air passage, and is blown obliquely downward from the forward air outlet 13. Thus the blown air likely flows downward, and therefore the heated air during heating operation likely reaches the feet.

That is, since the floor-positioned air-conditioning apparatus 100 includes the forward blowing control member 30 having the approximate right triangle cross section, during heating operation, the heated air can be guided by the forward-blowing-control-member inner surface 33 (corresponding to the oblique surface of the approximate right triangle) of the forward blowing control member 30, and the heated air can be blown downward.

Since the forward blowing control member 30 can be stopped at a predetermined rotation angle, the blowing direction of the heated air can be controlled by properly controlling the rotation angle.

At this time, the forward-blowing-control-member outer surface 31 is no longer parallel to the upward-blowing-control-member inner surface 42. Hence, the upward blowing control member 40*a* (or both the upward blowing control member 40*a* and the upward blowing control member 40*b*) is rotated (clockwise in the drawing) and retracted to allow the forward blowing control member 30 to rotate. When the forward blowing control member 30 is rotated by a rotation angle corresponding to processing, the upward blowing control member 40*a* is rotated (counterclockwise in the drawing) to bring the forward outer-surface upper end 31*a* into contact with the upward-blowing-control-member inner surface 42.

It is to be noted that the forward blowing control member 30 may have a hollow structure to reduce the weight thereof.

(Rotation Operation)

Referring to FIG. 5, rotation operation when the forward blowing control member 30 is opened is described.

When the forward blowing control member 30 is rotated while the upward blowing control member 40 closes the upward air outlet 14, the forward outer-surface upper end 31*a* interferes with the upward-blowing-control-member inner surface 42*a*. Owing to this, at least by temporarily opening the upward blowing control member 40*a* (clockwise in the drawing), the interference can be avoided.

Also, referring to FIG. 5, since both the upward blowing control member 40*a* and the upward blowing control member 40*b* are rotated, only the upward blowing control member 40*a* may be rotated if the upward blowing control member 40*a* does not interfere with the upward blowing control member 40*b*.

Further, the forward-blowing-control-member support 34 is provided near the forward outer-surface upper end 31*a* of the forward blowing control member 30. If the interference between the forward outer-surface upper end 31*a* and the upward-blowing-control-member inner surface 42 is negligible even when only the forward blowing control member 30 is rotated, the upward blowing control member 40*a* does not have to be rotated.

(Control System)

In FIG. 6, the floor-positioned air-conditioning apparatus 100 includes the remote controller 90 for activating/stopping the floor-positioned air-conditioning apparatus 100 and for setting an operation mode of the floor-positioned air-conditioning apparatus 100. Also, the interference detection sensor (input means) 70 is provided. The interference detection sensor 70 detects approach at a close distance or contact of the forward outer-surface upper end 31*a*, which is an upper edge of the forward-blowing-control-member outer surface 31, and the upward-inner-surface front end 45*a*, which is an edge of the upward-blowing-control-member inner surface 42*a* at the housing-front-surface-11 side. The forward blowing control member 30 is rotated by the forward-blowing-control-member motor (output means) 30*m*, and the upward blowing control members 40*a* and 40*b* are rotated by the respective upward-blowing-control-member motors (output means) 40*am* and 40*bm*.

That is, the instruction content provided from the remote controller 90 through the remote-controller input unit 81, and detection information of the interference detection sensor 70 are input to the controller 80. Also, signals that cause the forward-blowing-control-member motor 30*m* and the upward-blowing-control-member motors 40*am* and 40*bm* to be rotated are output from the controller 80.

(Flowchart)

Referring to FIG. 7, the controller 80 determines whether the operation is the cooling operation or the heating operation in accordance with a signal from the remote controller 90 (S1). For example, in case of the cooling operation, a signal for rotating the upward-blowing-control-member motors 40*am* and 40*bm* is emitted according to an operation menu, to open the upward blowing control members 40*a* and 40*b* (S2). Depending on the operation mode, only one of the upward blowing control members 40*a* and 40*b* may be rotated.

Then, the cooling operation is started, and the cooled air is blown upward as described above (S3). If a stop signal is input from the remote controller 90 (S4), a refrigeration cycle and the fan 24 are stopped (S5), and the upward blowing control members 40*a* and 40*b* are closed (S6).

In contrast, in case of the heating operation, a signal for rotating the upward-blowing-control-member motor 40*am* is emitted first, and the upward blowing control member 40*a* is slightly opened (S7) by a certain degree for eliminating interference with respect to the forward blowing control member 30. Then, a signal for rotating the forward-blowing-control-member motor 30*m* is emitted and the forward blowing control member 30 is opened (S8). Then, when the upward blowing control member 40*a* is returned and the upward air outlet 14 is closed (S9), the heating operation is started (S10). Then, the heated air is blown in the substantially horizontal direction as described above.

Further, if a stop signal from the remote controller 90 is input (S11), the refrigeration cycle and the fan 24 are stopped (S12), the upward blowing control member 40*a* is slightly opened (S13) similarly to start of the heating operation, then the forward blowing control member 30 is closed (S14), and finally the upward blowing control member 40*a* is closed (S15).

Embodiment 2: Floor-positioned Air-conditioning Apparatus

Figure 8:
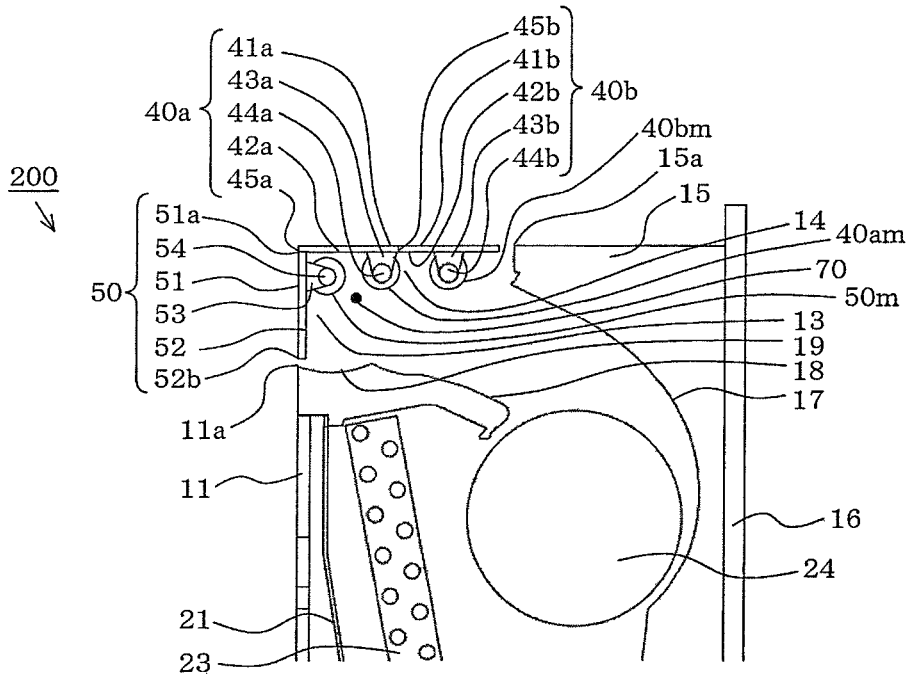
FIG. 8 is a cross-sectional view showing, during operation stop, an air-direction control mechanism of a floor-positioned air-conditioning apparatus according to Embodiment 2 of the invention.
Figure 9:
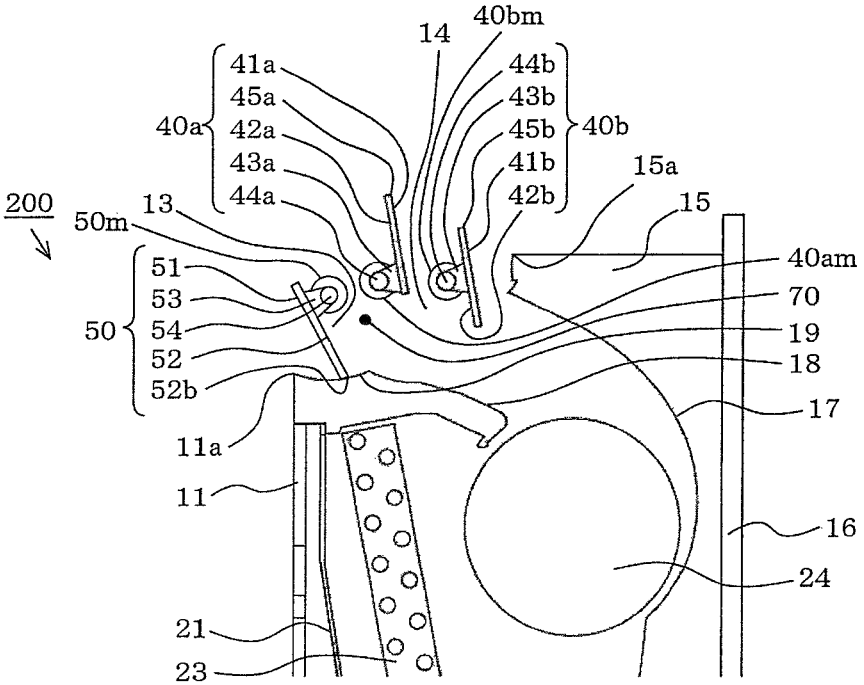
FIG. 9 is a cross-sectional view showing the air-direction control mechanism during cooling operation of the floor-positioned air-conditioning apparatus shown in FIG. 8.
Figure 10:
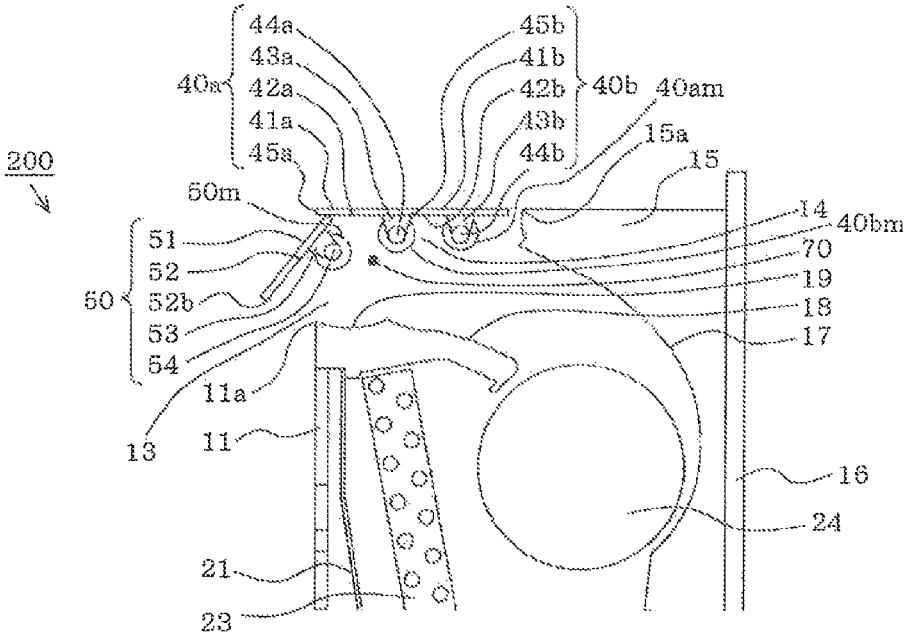
FIG. 10 is a cross-sectional view showing the air-direction control mechanism during heating operation of the floor-positioned air-conditioning apparatus shown in FIG. 8.

FIGS. 8 to 10 schematically explain a floor-positioned air-conditioning apparatus according to Embodiment 2 of the invention. FIG. 8 is a cross-sectional view showing an air-direction control mechanism during operation stop. FIG. 9 is a cross-sectional view showing the air-direction control mechanism during cooling operation. FIG. 10 is a cross-sectional view showing an operation of the air-direction control mechanism during heating operation. The same reference sign is applied to a portion that is the same as or corresponding to that of Embodiment 1, and explanation is partly omitted. Also, the respective drawings are schematically drawn. The invention is not limited to Embodiment 2.

In FIGS. 8 to 10, a floor-positioned air-conditioning apparatus 200 is provided such that the forward blowing control member 30 having an approximate right triangle cross section in the floor-positioned air-conditioning apparatus 100 (Embodiment 1) is changed to a plate-shaped forward blowing control member 50 likewise the upward blowing control member 40.

(During Operation Stop)

In FIG. 8, the forward blowing control member 50 included in the floor-positioned air-conditioning apparatus 200 is rotated by a forward-blowing-control-member motor 50*m*. The forward blowing control member 50 includes a forward-blowing-control-member outer surface 51 being a flat surface continued to the housing front surface 11 during operation stop (the forward-blowing-control-member outer surface 51 may not be continued to the housing front surface 11 by rotation during operation); a forward-blowing-control-member inner surface 52 being parallel to the forward-blowing-control-member outer surface 51; a forward-blowing-control-plate arm 53 provided to protrude from the forward-blowing-control-member inner surface 52; and a forward-blowing-control-member support 54 provided at a distal end of the forward-blowing-control-plate arm 53.

The forward blowing control member 50 is provided at the housing 10 rotatably about the forward-blowing-control-member support 54, and is rotated by the forward-blowing-control-member motor 50*m*.

At this time, a forward outer-surface upper end 51*a*, which is an upper edge of the forward-blowing-control-member outer surface 51, substantially contacts the upward inner-surface front end 45.

Hence, during operation stop, both the forward air outlet 13 and the upward air outlet 14 can be closed. Accordingly, apparent design of the floor-positioned air-conditioning apparatus 200 is prevented from being degraded, and dust and a foreign substance are prevented from entering the housing 10.

(During Cooling Operation)

In FIG. 9, during cooling operation, the upward blowing control member 40 opens the upward air outlet 14, and the forward blowing control member 50 closes the forward air outlet 13. The air (cooled air) passing through the fan 24 is blown upward from the upward air outlet 14.

At this time, since the forward blowing control member 50 is rotated (counterclockwise in the drawing), and a forward inner-surface lower end 52*b*, which is a lower edge of the forward-blowing-control-member inner surface 52, is moved to a position of the casing front surface 19 near the casing center surface 18, an air passage is formed. The air passage is surrounded by a curved surface formed by the forward-blowing-control-member inner surface 52 and the casing center surface 18, and the casing back surface 17 facing the curved surface. The air passage extends from the fan 24 to the upward air outlet 14.

Hence, the cooled air is smoothly guided through the air passage, and then the blowing direction is controlled to be in a predetermined direction by the upward blowing control member 40. Accordingly, turbulence of blown air can be suppressed.

Also, the casing front surface 19 has an arcuate cross section, and has a curvature radius that is substantially the same as the distance between the forward-blowing-control-member support 54 and the forward inner-surface lower end 52*b* (correctly, the curvature radius is slightly larger). Accordingly, when the cooled air is guided, the quantity of cooled air that is blown between the casing front surface 19 and the forward inner-surface lower end 52*b* is minimized.

(During Heating Operation)

In FIG. 10, during heating operation, the upward blowing control member 40 closes the upward air outlet 14, and the forward blowing control member 50 opens the forward air outlet 13. The air (heated air) passing through the fan 24 is blown forward from the forward air outlet 13.

At this time, the forward blowing control member 50 is inclined, and a substantially smoothly continuous curved surface (hereinafter, referred to as "upper curved surface") is formed by the casing back surface 17, the upward-blowing-control-member inner surface 42, and the forward-blowing-control-member inner surface 52. Also, a continuous curved surface (hereinafter, referred to as "lower curved surface") is formed by the casing center surface 18 and the casing front surface 19. Accordingly, an air passage surrounded by the upper curved surface and the lower curved surface and extending from the fan 24 to the forward air outlet 13 is formed.

Therefore, the heated air is smoothly guided through the air passage, and is blown obliquely downward from the forward air outlet 13. Thus the blown air likely flows downward, and therefore the heated air during heating operation likely reaches the feet.

Since the forward blowing control member 50 can be stopped at a predetermined rotation angle, the blowing direction of the heated air can be controlled by properly controlling the rotation angle.

At this time, since the forward blowing control member 50 interferes with the upward blowing control member 40*a*, as described above (Embodiment 1), the upward blowing control member 40*a* (or both the upward blowing control member 40*a* and the upward blowing control member 40*b*) is rotated (clockwise in the drawing) and retracted to allow the forward blowing control member 50 to rotate. When the forward blowing control member 50 is rotated by a rotation angle corresponding to processing, the upward blowing control member 40*a* is rotated (counterclockwise in the drawing) to bring the forward outer-surface upper end 51*a* into contact with the upward-blowing-control-member inner surface 42.

Embodiment 3: Floor-positioned Air-conditioning Apparatus

Figure 11:
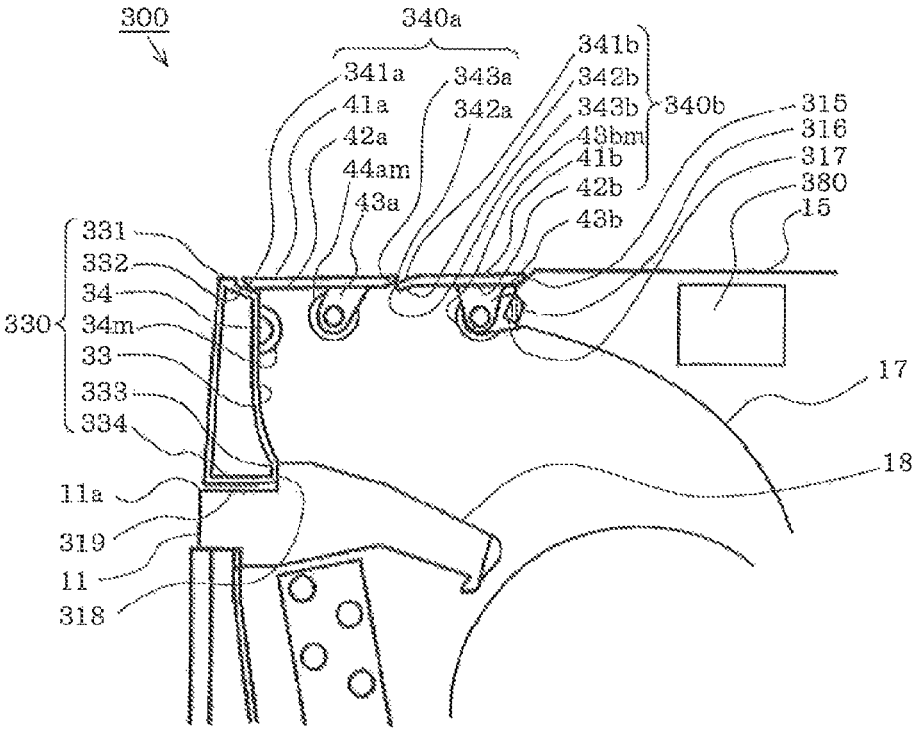
FIG. 11 is a cross-sectional view showing an operation stop posture in a partly enlarged manner for schematically explaining a floor-positioned air-conditioning apparatus according to Embodiment 3 of the invention.
Figure 12:
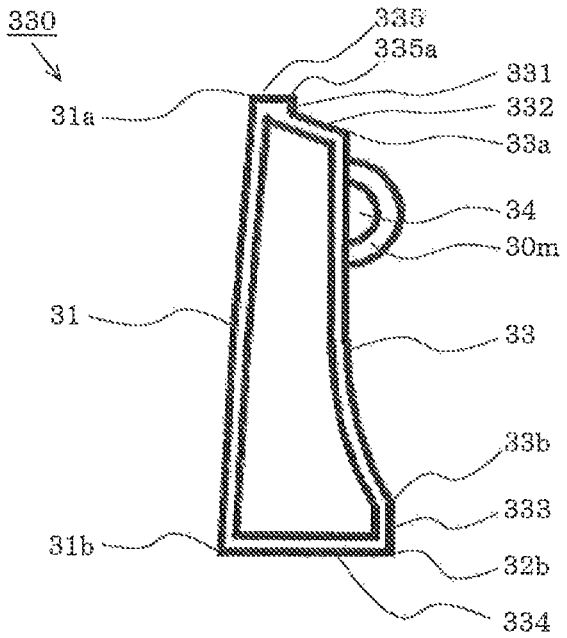
FIG. 12 is a cross-sectional view extracting and showing a portion of a component (forward blowing control member) of the floor-positioned air-conditioning apparatus shown in FIG. 11.
Figure 13A:
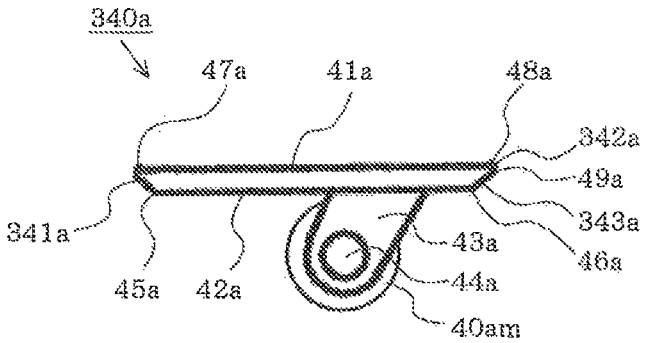
FIG. 13A is a cross-sectional view extracting and showing a portion of a component (upward blowing control member arranged at front) of the floor-positioned air-conditioning apparatus shown in FIG. 11.
Figure 13B:
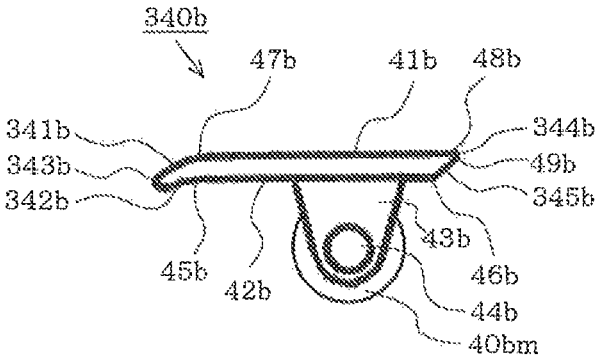
FIG. 13B is a cross-sectional view extracting and showing a portion of a component (upward blowing control member arranged at rear) of the floor-positioned air-conditioning apparatus shown in FIG. 11.
Figure 14A:
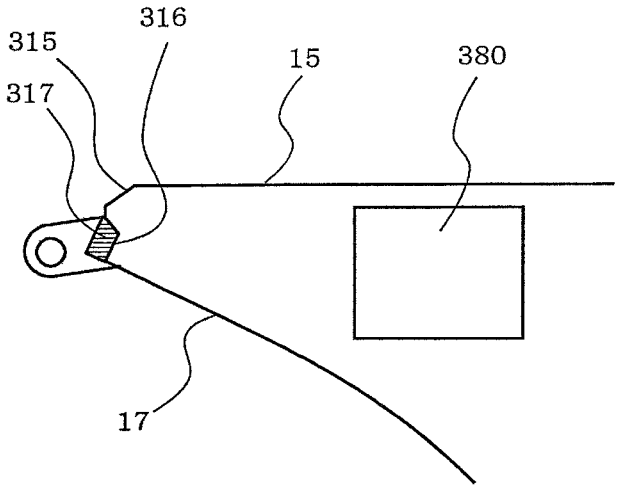
FIG. 14A is a cross-sectional view extracting and showing a portion of a component (housing top surface) of the floor-positioned air-conditioning apparatus shown in FIG. 11.
Figure 14B:
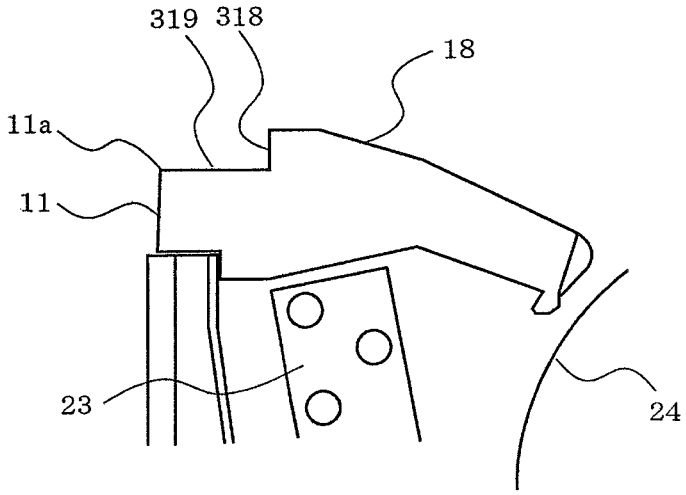
FIG. 14B is a cross-sectional view extracting and showing a portion of a component (casing front surface) of the floor-positioned air-conditioning apparatus shown in FIG. 11.

FIGS. 11 to 14B schematically explain a floor-positioned air-conditioning apparatus according to Embodiment 3 of the invention. FIG. 11 is a cross-sectional view showing an operation stop posture in a partly enlarged manner. FIG. 12 is a cross-sectional view extracting and showing a portion of a component (forward blowing control member). FIG. 13A is a cross-sectional view extracting and showing a portion of a component (upward blowing control member arranged at the front). FIG. 13B is a cross-sectional view extracting and showing a portion of a component (upward blowing control member arranged at the rear). FIG. 14A is a cross-sectional view extracting and showing a portion of a component (housing top surface). FIG. 14B is a cross-sectional view extracting and showing a portion of a component (casing front surface). The same reference sign is applied to a portion that is the same as or corresponding to that of Embodiment 1, and explanation is partly omitted. The respective drawings are schematically drawn. The invention is not limited to Embodiment 3.

In FIGS. 11 to 14B, a floor-positioned air-conditioning apparatus 300 is provided such that the forward blowing control member 30 in the floor-positioned air-conditioning apparatus 100 described in Embodiment 1 is replaced with a forward blowing control member (hereinafter, referred to as "F member") 330, the upward blowing control member 40 (correctly, the upward blowing control members 40*a* and 40*b*) is replaced with an upward blowing control member 340 (correctly, upward blowing control members (hereinafter, referred to as "U members") 340*a* and 340*b*), a housing top-surface front-end inclined surface (hereinafter, referred to as "housing top-surface inclined surface") 315 is formed at the top-surface front end 15*a* of the housing top surface 15, the casing front surface 19 is changed to a flat-surface-like casing front surface 319, and a casing step surface 318 is formed between the casing center surface 18 and the casing front surface 319.

Also, the floor-positioned air-conditioning apparatus 300 includes the U member 340*a* and the U member 340*b*; however, the invention does not limit the number of upward blowing control members. The U member 340*b* may be removed and the entire region of the upward air outlet 14 may be closed only by the U member 340*a*. Alternatively, two or more U members 340*b* may be provided at a rear-surface side of the U member 340*a*.

(Forward Blowing Control Member)

In FIG. 12, the F member 330 has an approximate right triangle shape or an approximate sector shape in side view. The F member 330 includes a forward-blowing-control-member outer surface (hereinafter, referred to as "F outer surface") 31 being a flat surface continued to the housing front surface 11 during operation stop (the F outer surface 31 may not be continued to the housing front surface 11 by rotation during operation (described later)); a forward-blowing-control-member bottom surface (hereinafter, referred to as "F bottom surface") 334 being a flat surface connected to a forward outer-surface lower end 31*b* of the F outer surface 31 and being perpendicular to the F outer surface 31; and a forward-blowing-control-member top surface (hereinafter, referred to as "F top surface") 335 connected to the forward outer-surface upper end 31*a* of the F outer surface 31.

Also, the F member 330 includes a forward-blowing-control-member top-surface step portion (hereinafter, referred to as "F top-surface step portion") 331 connected to a side edge 335*a* of the F top surface 335 located opposite to the forward outer-surface upper end 31*a*, and being parallel to the F outer surface 31; and a forward-blowing-control-member top-surface inclined portion (hereinafter, referred to as "F top-surface inclined portion") 332 connected to the F top-surface step portion 331 and inclined with respect to the F outer surface 31 in a direction away from the F outer surface 31 as extending toward a forward outer-surface lower end 31*b*.

That is, the F top-surface step portion 331 and the F top-surface inclined portion 332 form a "forward-blowing-control-member overlapped range."

Also, the F member 330 includes a forward-blowing-control-member inner surface (hereinafter, referred to as "F inner surface") 33 connected to a side edge 33*a* of the F top-surface inclined portion 332 located opposite to the F top-surface step portion 331, and smoothly inclined with respect to the F outer surface 31 in a direction away from the F outer surface 31 as extending toward the forward outer-surface lower end 31*b* in an arcuate shape (in the invention, a curve being smoothly curved, such as an arc, a portion of an ellipse, or a portion of a spiral, is collectively called "arcuate shape"); and a forward-blowing-control-member inner-surface step portion (hereinafter, referred to as "F inner-surface step portion") 333 connected to a side edge 33*b* of the F inner surface 33 located opposite to the F top-surface inclined portion 332, and being parallel to the F outer surface 31.

Further, a side edge 32*b* of the F inner-surface step portion 333 located opposite to the side edge 33*b* is connected to the forward outer-surface lower end 31*b* through the flat-plate-shaped F bottom surface 334.

Also, a forward-blowing-control-member support 34 is provided at the F inner surface 33.

(Upward Blowing Control Member Arranged Near Front Surface)

In FIG. 13A, the U member 340*a* arranged near the front surface includes an upward-blowing-control-member outer surface (hereinafter, referred to as "U outer surface") 41*a* being a flat surface that is stopped to be flush with the housing top surface 15 during operation stop (the U outer surface 41*a* may not be continued to the housing top surface 15 by rotation during operation (described later)); an upward-blowing-control-member inner surface (hereinafter, referred to as "U inner surface") 42*a* being parallel to the U outer surface 41*a*; an upward-blowing-control-plate arm 43*a* provided to protrude from the U inner surface 42*a*; and an upward-blowing-control-member support 44*a* provided at a distal end of the upward-blowing-control-plate arm 43*a*.

Further, in the U member 340*a*, the U outer surface 41*a* has a larger width (distance between an upward outer-surface front end 47*a* and an upward outer-surface rear end 48*a*) than a width of the U inner surface 42*a* (distance between an upward inner-surface front end 45*a* and an upward inner-surface rear end 46*a*), and an upward-blowing-control-member front-end arcuate surface (hereinafter, referred to as "UF arcuate surface") 341*a* having an arcuate cross section is formed between the upward outer-surface front end 47*a* and the upward inner-surface front end 45*a*.

That is, the UF arcuate surface 341*a* forms an "upward-blowing-control-member front overlapping range" of the U member 340*a*.

Also, the U member 340*a* includes an upward-blowing-control-member rear-end vertical surface (hereinafter, referred to as "UR vertical surface") 342*a* perpendicular to the U outer surface 41*a*; and an upward-blowing-control-member rear-end inclined surface (hereinafter, referred to as "UR inclined surface") 343*a* connecting an end portion 49*a* of the UR vertical surface 342*a* located opposite to the upward outer-surface rear end 48*a* with the upward inner-surface rear end 46*a*. That is, the UR inclined surface 343*a* forms an "upward-blowing-control-member rear overlapping range."

During operation stop (when the U outer surface 41*a* is located to be flush with the housing top surface 15), the UF arcuate surface 341*a* has a protruding shape facing an obliquely lower front side, and the UR inclined surface 343*a* faces the obliquely upper front side.

(Upward Blowing Control Member Arranged Near Rear Surface)

In FIG. 13B, the U member 340*b* arranged near the rear surface includes an upward-blowing-control-member outer surface 41*b* being a flat surface that is stopped to be flush with the housing top surface 15 during operation stop (the upward-blowing-control-member outer surface 41*b* may not be continued to the housing top surface 15 by rotation during operation (described later)); an upward-blowing-control-member inner surface 42*b* being parallel to the upward-blowing-control-member outer surface 41*b*; an upward-blowing-control-plate arm 43*b* provided to protrude from the upward-blowing-control-member inner surface 42*b*; and an upward-blowing-control-member support 44*b* provided at a distal end of the upward-blowing-control-plate arm 43*b*.

Further, the U member 340*b* includes an upward-blowing-control-member outer-surface front-end arcuate surface (hereinafter, referred to as "UF outer arcuate surface") 341*b* connected to an upward outer-surface front end 47*b* of the upward-blowing-control-member outer surface (hereinafter, referred to as "U outer surface") 41*b* and having an arcuate cross section extending gradually downward as approaching the front surface during operation stop (when the U outer surface 41*b* is located to be flush with the housing top surface 15); and an upward-blowing-control-member inner-surface front-end arcuate surface (hereinafter, referred to as "UF inner arcuate surface") 342*b* connected to an upward inner-surface front end 45*b* of the upward-blowing-control-member inner surface (hereinafter, referred to as "U inner surface") 42*b* and having an arcuate cross section extending gradually downward as approaching the front surface during operation stop.

The distance between the UF outer arcuate surface 341*b* and the UF inner arcuate surface 342*b* is gradually decreased as approaching the front surface. The respective distal ends are smoothly connected by an upward-blowing-control-member front-end distal-end surface (hereinafter, referred to as "UF distal-end surface") 343*b* having an arcuate cross section.

That is, the UF outer arcuate surface 341*b* and the UF inner arcuate surface 342*b* form an "upward-blowing-control-member front overlapped range."

Also, the U member 340*b* includes an upward-blowing-control-member rear-end vertical surface (hereinafter, referred to as "UR vertical surface") 344*b* connected to an upward outer-surface rear end 48*b* of the U outer surface 41*b* and perpendicular to the U outer surface 41*b*; and an upward-blowing-control-member rear-end inclined surface (hereinafter, referred to as "UR inclined surface") 345*b* connecting an end portion 49*b* of the UR vertical surface 344*b* located opposite to the upward outer-surface rear end 48*b* with an upward inner-surface rear end 46*b* and being a flat surface. That is, the UR inclined surface 345*b* forms an "upward-blowing-control-member rear overlapping range."

During operation stop (when the U outer surface 41*b* is located to be flush with the housing top surface 15), the UF outer arcuate surface 341*b* and the UF inner arcuate surface 342*b* form a protruding shape facing an obliquely upper front side, and the UR inclined surface 345*b* faces an obliquely lower front side.

(Housing Top Surface)

In FIG. 14A, provided in the housing top surface 15 is the housing top-surface inclined surface 315 connected to the top-surface front end 15*a* and inclined downward as approaching the front surface. The housing top-surface inclined surface 315 forms a "housing top-surface overlapped range."

Also, a housing top-surface lower inclined surface 316 being parallel to the housing top-surface inclined surface 315 and located below the housing top-surface inclined surface 315 is formed. A water absorber 317 is provided on the housing top-surface lower inclined surface 316. The front surface (upper surface) of the water absorber 317 is continued to the housing top-surface inclined surface 315.

(Casing Step Surface)

In FIG. 14B, the casing step surface 318 is formed between the casing center surface 18 and the casing front surface 319, and is parallel to the housing front surface 1.

(During Operation Stop)

During operation stop, the F member 330 closes the forward air outlet 13 while the F outer surface 31 is continued to the housing front surface 11, and the U members 340*a* and 340*b* close the upward air outlet 14 while the U outer surfaces 41*a* and 41*b* are continued to the housing top surface 15 (hereinafter, referred to as "operation stop posture").

At this time, the F top surface 335 of the F member 330 is flush with the U outer surface 41*a* of the U member 340*a*, the "upward-blowing-control-member front overlapping range" which is the UF arcuate surface 341*a* of the U member 340*a* overlaps the "forward-blowing-control-member overlapped range" which is a recess (dent) formed by the F top-surface step portion 331 and the F top-surface inclined portion 332 of the F member 330, and the UF arcuate surface 341*a* contacts the F top-surface inclined portion 332.

Also, the U outer surface 41*a* of the U member 340*a* at the front-surface side is flush with the U outer surface 41*b* of the U member 340*b* at the rear-surface side, the "upward-blowing-control-member rear overlapping range" which is the UR inclined surface 343*a* of the U member 340*a* located at the upper side overlaps the "upward-blowing-control-member front overlapped range" which is the UF outer arcuate surface 341*b* of the U member 340*b* located at the lower side, and the UF outer arcuate surface 341*b* contacts the UR inclined surface 343*a*.

Further, the U outer surface 41*b* of the U member 340*b* is flush with the housing top surface 15, the "upward-blowing-control-member rear overlapping range" which is the UR inclined surface 345*b* of the U member 340*b* overlaps the "housing front-surface overlapped range" which is the housing top-surface inclined surface 315 formed at the top-surface front end 15*a* of the housing top surface 15, and the UR inclined surface 345*b* contacts the housing top-surface inclined surface 315.

As described above, in the floor-positioned air-conditioning apparatus 300, in the operation stop posture, the F member 330 and the U member 340*a* partly overlap each other, the U member 340*a* and the U member 340*b* partly overlap each other, and further the U member 340*b* and the housing top surface 15 partly overlap each other (in the overlapping ranges and the overlapped ranges). Accordingly, the upward air outlet 14 of the housing 10 is reliably covered without a gap.

Hence, even if member molding accuracy and assembling accuracy vary although design is made with dimensions without a gap on the design drawing, a gap is not formed between members, design is improved, and dust and other substance can be prevented from entering the housing 10 from the upper side.

Also, since the F outer surface 31 of the F member 330 is flush with the housing front surface 11, and the F inner-surface step portion 333 contacts the casing step surface 318 formed between the casing center surface 18 and the casing front surface 319, dust and other substance can be prevented from entering the housing 10 from the front side.

Described above is the case in which the respective members contact each other at the overlapping and overlapped portions of the members. However, the invention is not limited thereto. To eliminate or reduce the sound generated by the contact (collision), an elastic member (soft material such as sponge or implanted fiber) may be arranged at one of the overlapping and overlapped portions, and direct contact between the overlapping and overlapped portions may be avoided.

Further, one of the overlapping and overlapped portions has a flat surface and the other has an arcuate cross section protruding toward the flat surface; however, the one may have an arcuate cross section and the other may have a flat surface. That is, the F top-surface inclined portion 332 may have an arcuate cross section protruding to an obliquely upper rear side and the UF arcuate surface 341*a* may have a flat surface. Similarly, the UR inclined surface 343*a* may have an arcuate cross section protruding to an obliquely lower rear side and the UF outer arcuate surface 341*b* may have a flat surface inclined downward as approaching the front side.

Further, the casing step surface 318 may be non-parallel to (may be inclined to) the housing front surface 11, and the F inner-surface step portion 333 may be non-parallel to (may be inclined to) the F outer surface 31 by a certain degree similar to the non-parallel state of the housing front surface 11.

Figure 15:
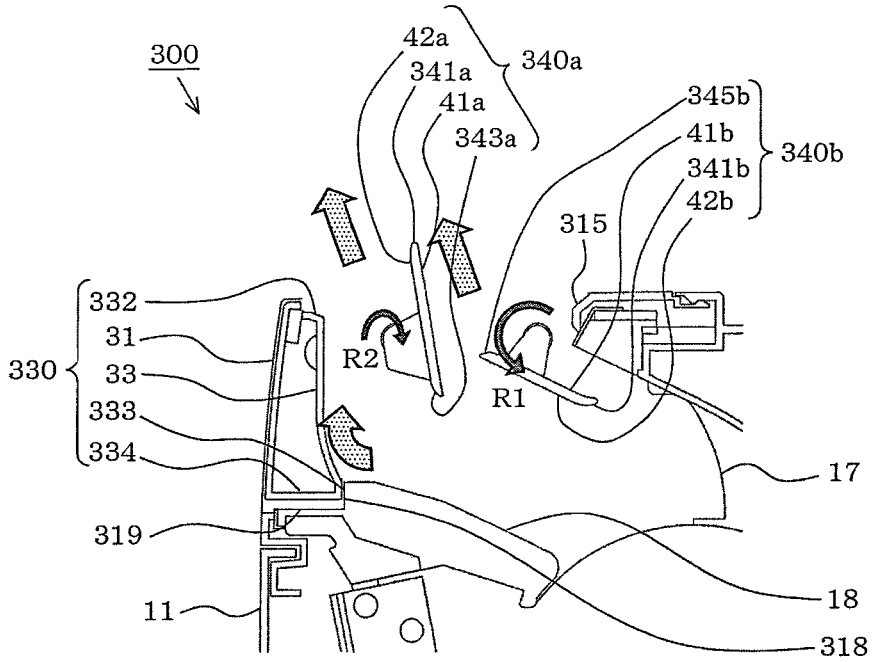
FIG. 15 is a cross-sectional view showing a cooling operation (upward blowing operation) posture in a partly enlarged manner of the floor-positioned air-conditioning apparatus shown in FIG. 11.
Figure 16:
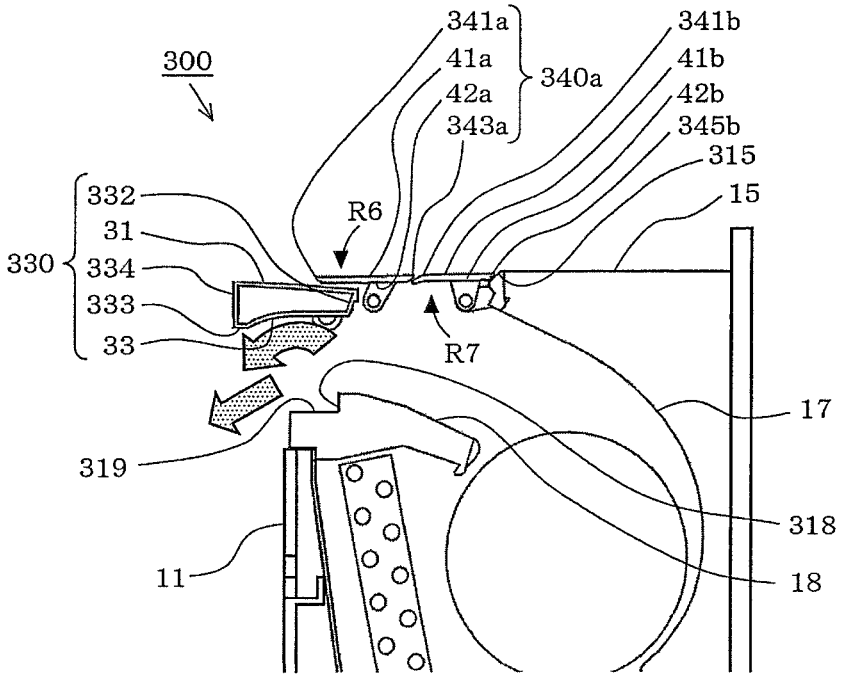
FIG. 16 is a cross-sectional view showing a heating operation (downward blowing operation) posture in a partly enlarged manner of the floor-positioned air-conditioning apparatus shown in FIG. 11.
Figure 17A:
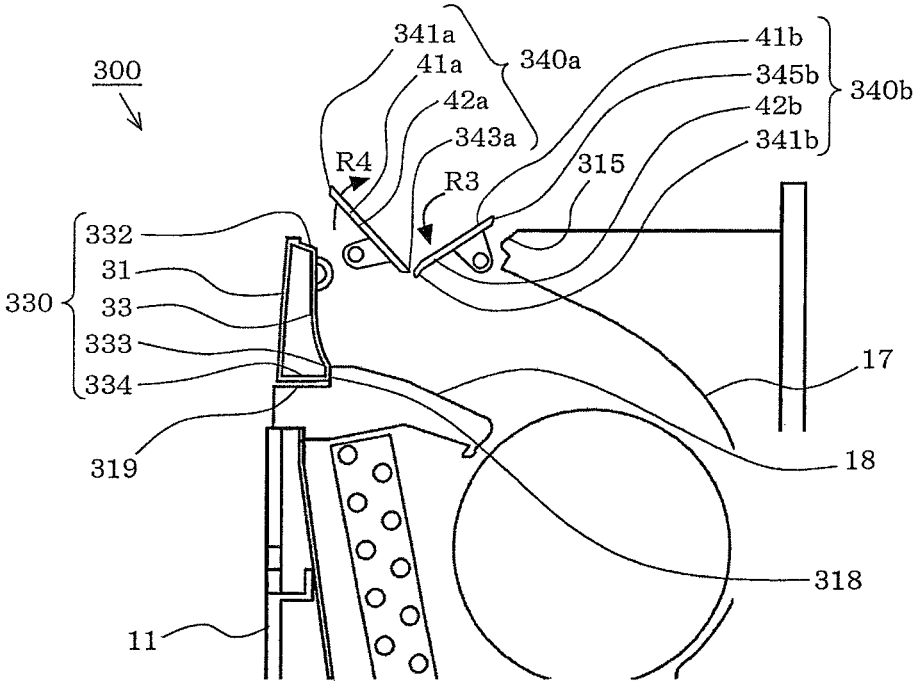
FIG. 17A is a cross-sectional view showing operation of providing the heating operation posture of the floor-positioned air-conditioning apparatus shown in FIG. 11.
Figure 17B:
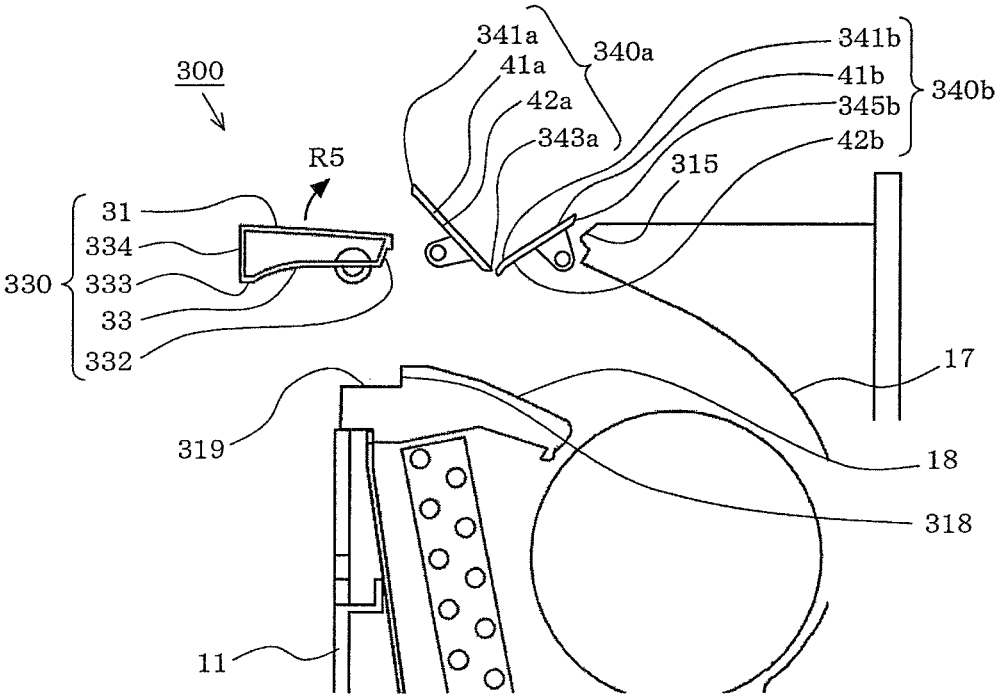
FIG. 17B is a cross-sectional view showing operation of providing the heating operation posture of the floor-positioned air-conditioning apparatus shown in FIG. 11.
Figure 18:
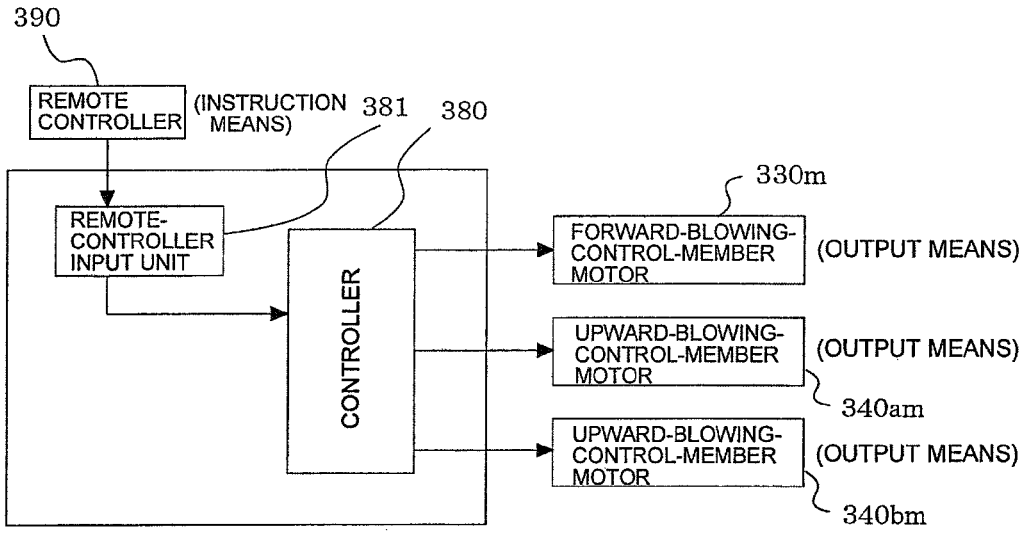
FIG. 18 is a block diagram showing a control system of the floor-positioned air-conditioning apparatus shown in FIG. 11.

FIGS. 15 to 19 schematically explain the floor-positioned air-conditioning apparatus according to Embodiment 3 of the invention. FIG. 15 is a cross-sectional view showing a cooling operation (upward blowing operation) posture in a partly enlarged manner. FIG. 16 is a cross-sectional view showing a heating operation (downward blowing operation) posture in a partly enlarged manner. FIGS. 17A and 17B are cross-sectional views showing operation of providing the heating operation posture. FIG. 18 is a block diagram showing a control system. FIGS. 19A and 19B are flowcharts explaining the control system. The same reference sign is applied to a portion that is the same as or corresponding to that of Embodiment 1, and explanation is partly omitted. The respective drawings are schematically drawn. The invention is not limited to Embodiment 3.

(Posture During Cooling Operation)

In FIG. 15, during cooling operation, the U members 340*a* and 340*b* open the upward air outlet 14, and the F member 330 closes the forward air outlet 13. The air (cooled air) passing through the fan 24 is blown upward from the upward air outlet 14.

At this time, the U member 340*b* arranged at the rear enters the housing 10, and is stopped in a posture substantially parallel to the casing back surface 17 (at an angle determined in accordance with an operation condition). In contrast, the U member 340*a* arranged at the front is stopped in a substantially vertical posture (correctly, at an angle determined in accordance with an operation condition with a slight inclination so that the U member 340*a* is located at the further front side as approaching the upper side) while protruding to the outside of the housing 10. The F inner surface 33 of the F member 330 is smoothly continued to the casing center surface 18 (hereinafter, referred to as "cooling operation posture").

Hence, an air passage extending from the fan 24 to the upward air outlet 14 surrounded by a curved surface (with a substantially arcuate cross section) formed by the F inner surface 33 and the casing center surface 18, and the casing back surface 17 facing the curved surface, is formed. The cooled air blown by the fan 24 is blown to an obliquely upper side.

At this time, the cooled air can be further reliably guided by an amount that the U member 340*b* arranged at the rear approaches the fan 24.

Also, since the F inner-surface step portion 333 contacts the casing step surface 318, the cooled air blown by the fan 24 can be prevented from leaking to the housing front surface 11. Also, if an elastic body (body that improves hermeticity in addition to elimination or reduction of noise as described above, not shown) is provided at one or both of the F inner-surface step portion 333 and the casing step surface 318, the leakage can be further reliably prevented.

Further, even if a gap is formed between the F inner-surface step portion 333 and the casing step surface 318, since the casing front surface 319 faces the F bottom surface 334 with a slight gap arranged therebetween, a passage (gap) extending from the casing center surface 18 to the housing front surface 11 has an L-shaped cross section and hence the passage is bent in the middle. Accordingly, the cooled air which leaks to the front-surface side of the housing 10 through the passage can be minimized.

(Operation at Start of Cooling Operation)

In FIG. 15, operation of the U members 340*a* and 340*b* at start of cooling operation is described.

During operation stop, since the U member 340*a* at the front-surface side partly overlaps the U member 340*b* at the rear-surface side, both of the members cannot be rotated simultaneously. Hence, first, the U member 340*b* at the rear is rotated in a direction indicated by arrow R1 (counterclockwise in the drawing) and is stopped at a predetermined stop position, to move downward the UF arcuate surface 341*b* at the rear-surface side and the lower side. Then, the U member 340*a* at the front is rotated in a direction indicated by arrow R2 (clockwise in the drawing) and is stopped at a predetermined stop position, to move downward the UR inclined surface 343*a* at the front-surface side and the upper side.

(Operation at End of Cooling Operation)

In contrast, at end of cooling operation, the respective steps at start of cooling operation are executed backward. That is, first, the U member 340*a* at the front is rotated in the direction opposite to arrow R2 (counterclockwise in the drawing) to press the UF arcuate surface 341*a* of the U member 340*a* at the front to the F top-surface inclined portion 332 of the F member 330.

Then, the U member 340*b* at the rear is rotated in the direction opposite to arrow R1 (clockwise in the drawing) to press the UF arcuate surface 341*b* of the U member 340*b* at the rear front to the UR inclined surface 343*a* of the U member 340*a* at the front. At this time, the UR inclined surface 345*b* of the U member 340*b* at the rear contacts the housing top-surface inclined surface 315.

(Posture During Heating Operation)

In FIG. 16, during heating operation, the U members 340*a* and 340*b* close the upward air outlet 14, and the F member 330 opens the forward air outlet 13. The air (heated air) passing through the fan 24 is blown forward from the forward air outlet 13.

At this time, the U inner surface 42*a* of the U member 340*a* at the front, the U inner surface 42*b* of the U member 340*b* at the rear, and the housing top surface 15 are flush with each other, and partly overlap each other as described above. Also, the F outer surface 31 of the F member 330 contacts the U inner surface 42*a* of the U member 340*a* at the front (correctly, the upward inner-surface front end 45*a*), and is in a posture approximately parallel to the U outer surface 41*a* (hereinafter, referred to as "heating operation posture").

Hence, a smoothly continuous curved surface (hereinafter, referred to as "upper curved surface") is formed by the casing back surface 17, the U inner surface 42*b*, the U inner surface 42*a*, and the F inner surface 33. Also, a smoothly continuous curved surface (hereinafter, referred to as "lower curved surface") is formed by the casing center surface 18 and the casing front surface 319. Accordingly, an air passage surrounded by the upper curved surface and the lower curved surface and extending from the fan 24 to the forward air outlet 13 is formed.

Therefore, the heated air is smoothly guided through the air passage, and then is blown obliquely downward from the forward air outlet 13. Thus the blown air likely flows downward, and therefore the heated air during heating operation likely reaches the feet.

At this time, the housing top surface 15 partly overlaps the U inner surface 42*b* at the rear-surface side, and the U inner surface 42*b* at the rear-surface side partly overlaps the U inner surface 42*a* at the front-surface side. Also, the U inner surface 42*a* at the front-surface side partly contacts the F outer surface 31. Accordingly, the leakage of the heated air from the upper curved surface is minimized.

That is, since the floor-positioned air-conditioning apparatus 300 includes the F member 330 having the approximate right triangle cross section or the approximate sector cross section, during heating operation, the heated air can be guided by the F inner surface 33 (corresponding to the oblique surface of the approximate right triangle) of the F member 330, and the heated air can be blown downward.

Since the F member 330 can be stopped at a predetermined rotation angle, the blowing direction of the heated air can be controlled by properly controlling the rotation angle. At this time, the forward outer-surface upper end 31*a* of the F member 330 hermetically contacts the U inner surface 42*a* of the U member 340*a* at the front-surface side.

(Operation at Start of Heating Operation)

In FIGS. 16, 17A, and 17B, operation of the F member 330 during heating operation is described. During operation stop, since the UF arcuate surface 341*a* of the U member 340*a* at the front covers (overlaps) the forward-blowing-control-member top-surface inclined portion 332 of the F member 330, the F member 330 cannot be rotated unless the overlap is eliminated.

That is, first, like the situation during cooling operation, the U member 340*b* at the rear is slightly rotated in a direction indicated by arrow R3 (counterclockwise in the drawing) and is stopped, to move downward the UF outer arcuate surface 341*b* at the lower side. Then, the U member 340*a* at the front is slightly rotated in a direction indicated by arrow R4 (clockwise in the drawing) and is stopped, to move upward the UF arcuate surface 341*a* at the upper side. At this time, the rotation angle of the U member 340*b* at the rear is determined such that the upward outer-surface rear end 48*a* does not interfere with the UF distal-end surface 343*b* even if the U member 340*a* at the front is rotated (see FIG. 17A).

Hence, the F member 330 is rotated in a direction indicated by arrow R5 (clockwise in the drawing) until the F outer surface 31 becomes horizontal (see FIG. 17B).

Further, the U member 340*a* at the front is slightly rotated in the direction opposite to the above-described direction (direction indicated by arrow R6 (counterclockwise in the drawing)) to press the upward-blowing-control-member inner surface 42*a* to the F outer surface 31. Further, the U member 340*b* at the rear is rotated in the direction opposite to the above-described direction (direction indicated by arrow R7 (clockwise in the drawing)) to press the UF outer arcuate surface 341*b* to the UR inclined surface 343*a* of the U member 340*a* at the front.

(Operation at End of Heating Operation)

In contrast, at end of heating operation, the respective steps at start of heating operation are executed backward. That is, first, the U member 340*b* at the rear is slightly rotated in the direction opposite to arrow R7 (counterclockwise in the drawing), and the U member 340*a* at the front is slightly rotated in the direction opposite to arrow R6 (clockwise in the drawing).

Then, the F member 330 is rotated in the direction opposite to arrow R5 (counterclockwise in the drawing) to press the F inner-surface step portion 333 to the casing step surface 318.

Further, the U member 340*a* at the front is rotated in the direction opposite to arrow R4 (counterclockwise in the drawing) to press the UF arcuate surface 341*a* of the U member 340*a* at the front to the F top-surface inclined portion 332 of the F member 330.

Then, the U member 340*b* at the rear is rotated in the direction opposite to arrow R3 (clockwise in the drawing) to press the UF outer arcuate surface 341*b* of the U member 340*b* at the rear to the UR inclined surface 343*a* of the U member 340*a* at the front. At this time, the UR inclined surface 345*b* of the U member 340*b* at the rear contacts the housing top-surface inclined surface 315.

(Control System)

In FIG. 18, the floor-positioned air-conditioning apparatus 300 includes a remote controller 390 for activating/stopping the floor-positioned air-conditioning apparatus 300 and for setting an operation mode of the floor-positioned air-conditioning apparatus 300. Also, the F member 330 is rotated by a forward-blowing-control-member motor (output means) 330*m*, and the U members 340*a* and 340*b* are rotated by respective upward-blowing-control-member motors (output means) 340*am* and 340*bm*.

That is, the instruction content provided from the remote controller 390 through the remote-controller input unit 381 is input to the controller 380. Also, signals that cause the forward-blowing-control-member motor 330*m* and the upward-blowing-control-member motors 340*am* and 340*bm* to be rotated are output from the controller 380.

(Flowchart)

In FIGS. 19A, 19B, and 15 to 17B, a function of the controller 380 in the floor-positioned air-conditioning apparatus 300 is described.

The controller 380 determines whether operation is the cooling operation (upward blowing operation) or the heating operation (downward blowing operation) in accordance with a signal from the remote controller 390 (S1).

(At Start of Cooling Operation)

Figure 19A:
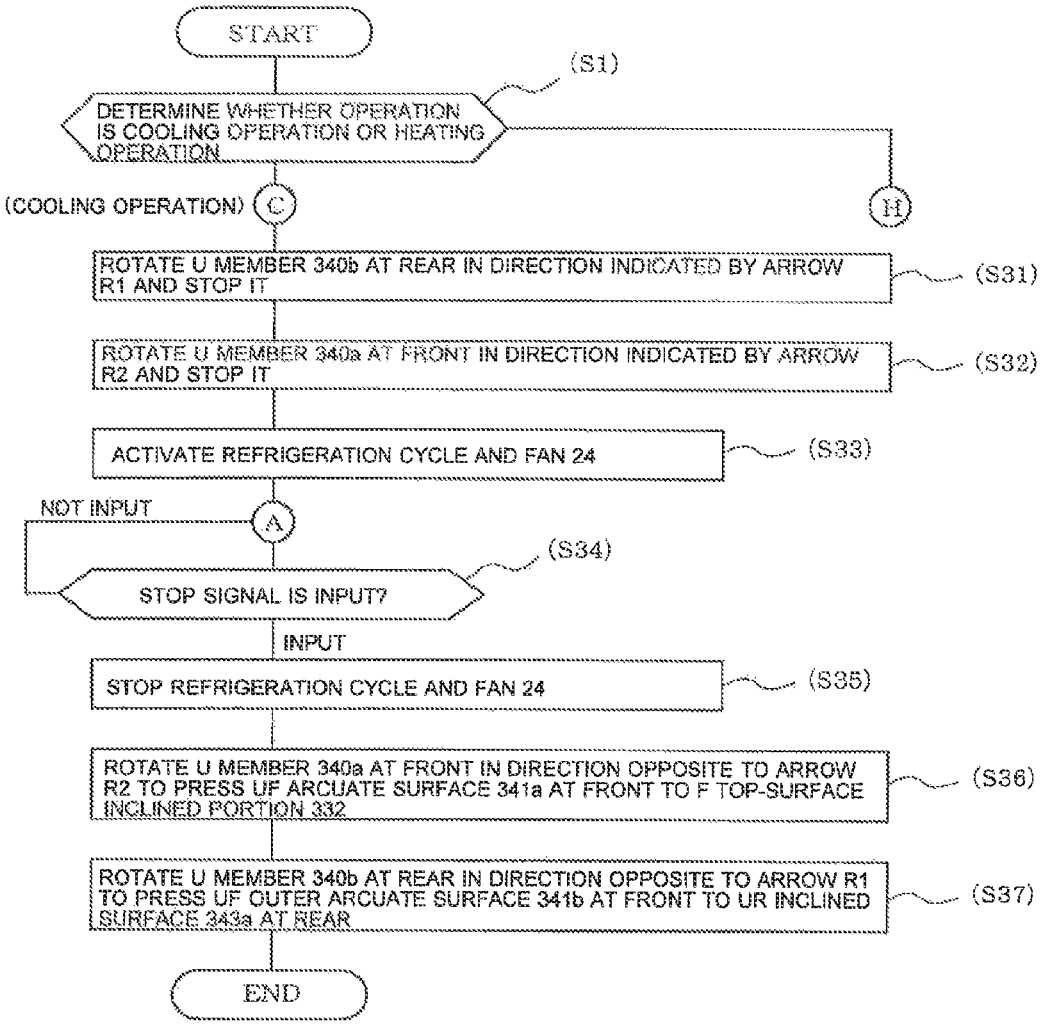
FIG. 19A is a flowchart explaining the control system of the floor-positioned air-conditioning apparatus shown in FIG. 11.

In FIG. 19A, at start of cooling operation, since the U member 340*a* partly overlaps the U member 340*b* during operation stop as described above, both of the members cannot be rotated simultaneously. Hence, first, the U member 340*b* at the rear is rotated in the direction indicated by arrow R1 (counterclockwise in the drawing) and is stopped at a predetermined stop position, to move downward the UF outer arcuate surface 341*b* at the lower side (S31).

Then, the U member 340*a* at the front is rotated in the direction indicated by arrow R2 (clockwise in the drawing) and is stopped at a predetermined stop position, to move downward the UR inclined surface 343*a* at the upper side (S32).

That is, the controller 380 emits signals for rotating the upward-blowing-control-member motors 340*am* and 340*bm* in accordance with an operation menu to rotate the U members 340*a* and 340*b* and open the upward air outlet 14. Accordingly, the posture becomes the cooling operation posture (see FIG. 15), and then the refrigeration cycle and the fan 24 are activated (S33).

(Operation at End of Cooling Operation)

Further, when a stop signal is input from the remote controller 390 (S34), the refrigeration cycle and the fan 24 are stopped (S35).

Then, the respective steps at start of cooling operation are executed backward. That is, first, the U member 340*a* at the front is rotated in the direction opposite to arrow R2 (counterclockwise in FIG. 15) to press the UF arcuate surface 341*a* of the U member 340*a* at the front to the F top-surface inclined portion 332 of the F member 330 (S36).

Then, the U member 340*b* at the rear is rotated in the direction opposite to arrow R1 (clockwise in FIG. 15) to press the UF outer arcuate surface 341*b* of the U member 340*b* at the rear to the UR inclined surface 343*a* of the U member 340*b* at the rear (S37). At this time, the UR inclined surface 345*b* of the U member 340*a* at the front contacts the housing top-surface inclined surface 315, and the posture becomes the operation stop posture.

(Operation at Start of Heating Operation)

Figure 19B:
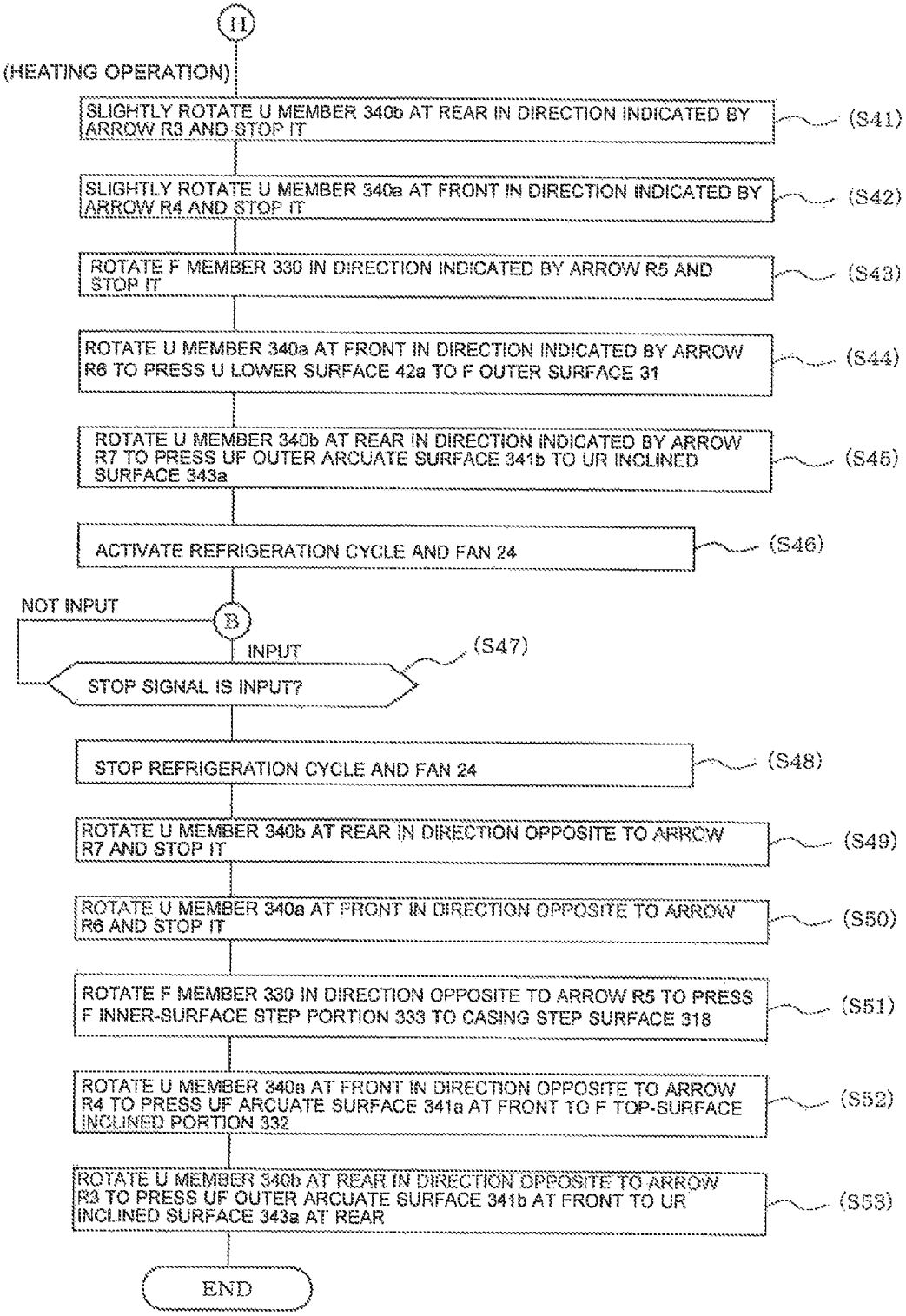
FIG. 19B is a flowchart explaining the control system of the floor-positioned air-conditioning apparatus shown in FIG. 11.

In FIG. 19B, as described above, during operation stop, since the UF arcuate surface 341*a* of the U member 340*a* at the front covers (overlaps) the forward-blowing-control-member top-surface inclined portion 332 of the F member 330, the F member 330 cannot be rotated unless the overlap is eliminated.

That is, first, like the situation during cooling operation, the U member 340*b* at the rear is slightly rotated in the direction indicated by arrow R3 (counterclockwise in FIG. 17A) and is stopped, to move downward the UF outer arcuate surface 341*b* at the lower side (S41).

Then, the U member 340*a* at the front is slightly rotated in the direction indicated by arrow R4 (clockwise in FIG. 17A) and is stopped, to move upward the UF arcuate surface 341*a* at the upper side (S42). At this time, the rotation angle of the U member 340*b* at the rear is determined such that the upward outer-surface rear end 48*a* does not interfere with the UF distal-end surface 343*b* even if the U member 340*a* at the front is rotated (see FIG. 17A).

Hence, the F member 330 is rotated in the direction indicated by arrow R5 (clockwise in FIG. 17B) until the F outer surface 31 becomes horizontal and is stopped (S43).

Further, the U member 340*a* at the front is slightly rotated in the direction indicated by arrow R6 (counterclockwise in FIG. 16) to press the U inner surface 42*a* to the F outer surface 31 (S44).

Further, the U member 340*b* at the rear is slightly rotated in the direction indicated by arrow R7 (clockwise in FIG. 16) to press the UF outer arcuate surface 341*b* to the UR inclined surface 343*a* of the U member 340*a* at the front (S45).

Accordingly, the posture becomes the heating operation posture, and then the refrigeration cycle and the fan 24 are activated (S46).

(Operation at End of Heating Operation)

Further, when a stop signal is input from the remote controller 390 (S47), the refrigeration cycle and the fan 24 are stopped (S48).

Then, the respective steps at start of heating operation are executed backward. That is, first, the U member 340*b* at the rear is slightly rotated in the direction opposite to arrow R7 (counterclockwise in FIG. 16) and is stopped (S49), and the U member 340*a* at the front is slightly rotated in the direction opposite to arrow R6 (clockwise in FIG. 16) and is stopped (S50).

Then, the F member 330 is rotated in the direction opposite to arrow R5 (counterclockwise in FIG. 17B) to press the F inner-surface step portion 333 to the casing step surface 318 (S51).

Further, the U member 340*a* at the front is rotated in the direction opposite to arrow R4 (counterclockwise in FIG. 17A) to press the UF arcuate surface 341*a* of the U member 340*a* at the front to the F top-surface inclined portion 332 of the F member 330 (S52).

Then, the U member 340*b* at the rear is rotated in the direction opposite to arrow R3 (clockwise in FIG. 17A) to press the UF outer arcuate surface 341*b* of the U member 340*b* at the rear to the UR inclined surface 343*a* of the U member 340*a* at the front (S53). At this time, the UR inclined surface 345*b* of the U member 340*b* at the rear contacts the housing top-surface inclined surface 315, and the posture becomes the operation stop posture.

(Modifications)

Figure 20A:
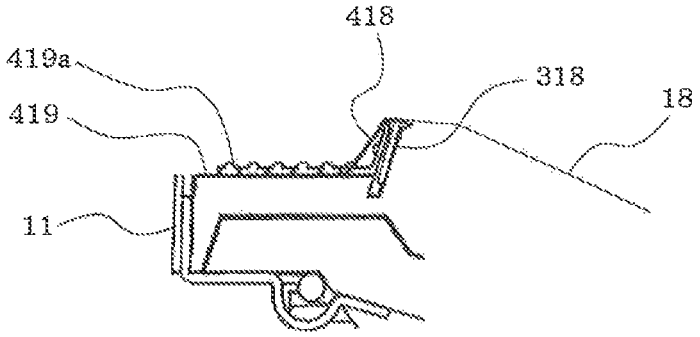
FIG. 20A is a cross-sectional view schematically explaining a modification of a component (casing front surface) of the floor-positioned air-conditioning apparatus shown in FIG. 11.
Figure 20B:
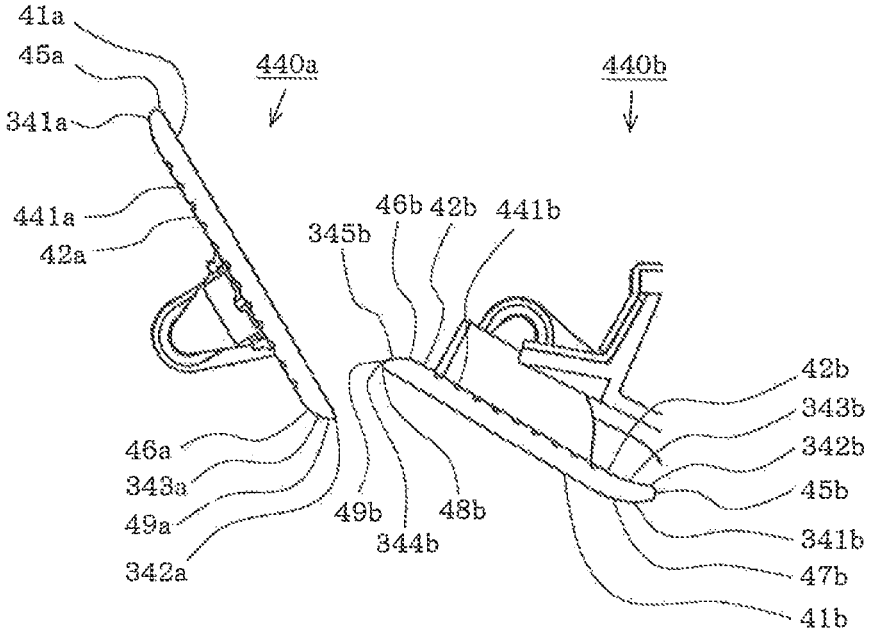
FIG. 20B is a cross-sectional view schematically explaining a modification of a component (upward blowing control member) of the floor-positioned air-conditioning apparatus shown in FIG. 11.
Figure 20C:
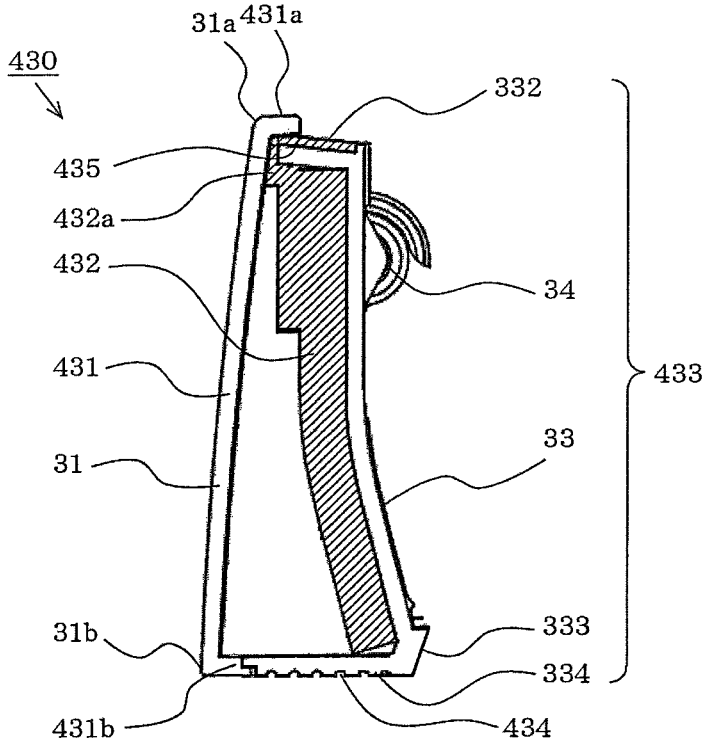
FIG. 20C is a cross-sectional view schematically explaining a modification of a component (forward blowing control member) of the floor-positioned air-conditioning apparatus shown in FIG. 11.

FIGS. 20A to 20C schematically explain modifications of components of the floor-positioned air-conditioning apparatus according to Embodiment 3 of the invention. FIG. 20A illustrates a casing front surface, FIG. 20B illustrates an upward blowing control member, and FIG. 20C illustrates a forward blowing control member. The same reference sign is applied to a portion that is the same as or corresponding to that in FIGS. 11 to 19, and explanation is partly omitted. The respective drawings are schematically drawn. The invention is not limited to Embodiment 3 or modifications.

In FIG. 20A, a casing front surface 419 is formed by providing a plurality of projections and depressions 419*a* at the casing front surface 319. The projections and depressions 419*a* are parallel to the housing front surface 11. Hence, the cooled air hardly leaks through a gap between the casing front surface 419 and the F bottom surface 334.

The shape and size of each projections and depressions 419*a* are not limited. For example, each depression has a square cross section with a depth of about 1 mm, and each projection has a width (gap between depressions) of about 1 mm.

Also, an elastic member 418 is provided at the casing step surface 318. The elastic member 418 is, for example, a rubber member having elasticity. Hence, noise is eliminated or reduced, and hermeticity (sealing performance) is improved.

In FIG. 20B, upward blowing control members 440*a* and 440*b* have a plurality of recessed grooves 441*a* and a plurality of recessed grooves 441*b*, respectively, at the U inner surfaces 42*a* and 42*b* of the U members 340*a* and 340*b*. The recessed grooves 441*a* and 441*b* are parallel to the upward inner-surface front ends 45*a* and 45*b*. Hence, even if water condensation occurs on the U inner surfaces 42*a* and 42*b*, condensed water adheres to the recessed grooves 441*a* and 441*b* because of the surface tension of water. Accordingly, the condensed water is prevented from being dropped in the housing 10.

In FIG. 20C, a forward blowing control member 430 is formed by hollowing the F member 330, and includes a forward outer-surface member 431 including the F outer surface 31; a forward inner-surface member 433 having a U-shaped (angular C-shaped) cross section and including the F inner surface 33, the F top-surface inclined portion 332, the F inner-surface step portion 333, and the F bottom surface 334; and a forward heat insulator 432.

In the forward outer-surface member 431, a forward upper flange 431*a* and a forward lower flange 431*b* protruding toward the F inner surface 33 are formed at the forward outer-surface upper end 31*a* and the forward outer-surface lower end 31*b*, respectively.

The forward heat insulator 432 is bonded to the front-surface side of the F inner surface 33 forming the forward inner-surface member 433. A plate-shaped heat-insulator overlapped surface 435 is formed above the forward heat insulator 432 through a heat-insulator joint portion 432*a*. The heat-insulator joint portion 432*a* is sandwiched and pressed by an end surface of the F top-surface inclined portion 332 at the front-surface side and a surface of the F outer surface 31 at the rear-surface side. The heat-insulator overlapped surface 435 is bonded to the F top-surface inclined portion 332. A portion of the heat-insulator overlapped surface 435 is sandwiched and pressed by an upper surface of the F top-surface inclined portion 332 and a lower surface of the forward upper flange 431*a*.

Further, a distal end of the F bottom surface 334 at the front-surface side is joined to the forward lower flange 431*b*. A plurality of protrusions and depressions 434 parallel to the F outer surface 31 are provided at a lower surface of the F bottom surface 334.

Hence, the forward outer-surface member 431 is rigidly joined to the forward inner-surface member 433. Also, during cooling operation, even if the F inner surface 33 is cooled, cooling energy is prevented from being transmitted to the F outer surface 31 by the forward heat insulator 432. Accordingly, water condensation at the F outer surface 31 is prevented.

Further, direct contact between the UF arcuate surface 341*a* of the U member 340*a* at a front-surface side and the F top-surface inclined portion 332 is avoided, and the heat-insulator overlapped surface 435 has a noise-elimination or noise-reduction function. Accordingly, sound and vibration can be prevented from being generated when a portion of the U member 340*a* at the front-surface side overlaps the forward blowing control member 430.

Further, the conditioned air hardly flows through a gap between the F bottom surface 334 and the casing front surface 319 because of the projections and depressions 434.

Any of the above-described modifications may be properly selected and may be partly applied to the floor-positioned air-conditioning apparatus 300.

Embodiment 4: Floor-positioned Air-conditioning Apparatus

Figure 21A:
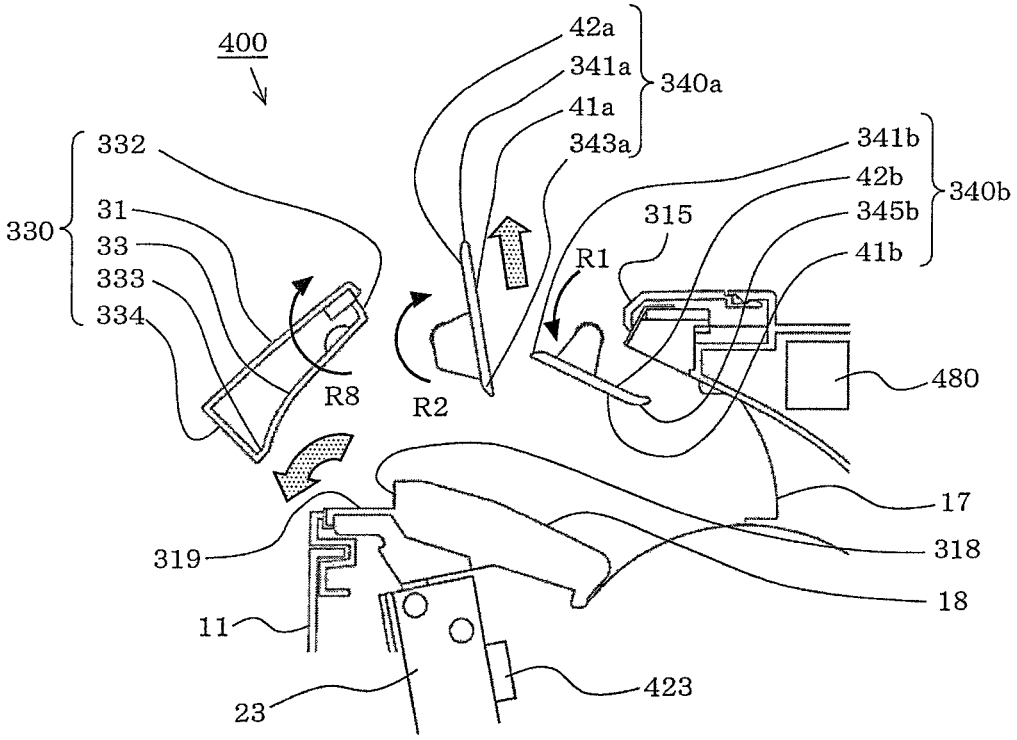
FIG. 21A is a cross-sectional view showing an upward/downward blowing operation posture in a partly enlarged manner for schematically explaining a floor-positioned air-conditioning apparatus according to Embodiment 4 of the invention.
Figure 21B:
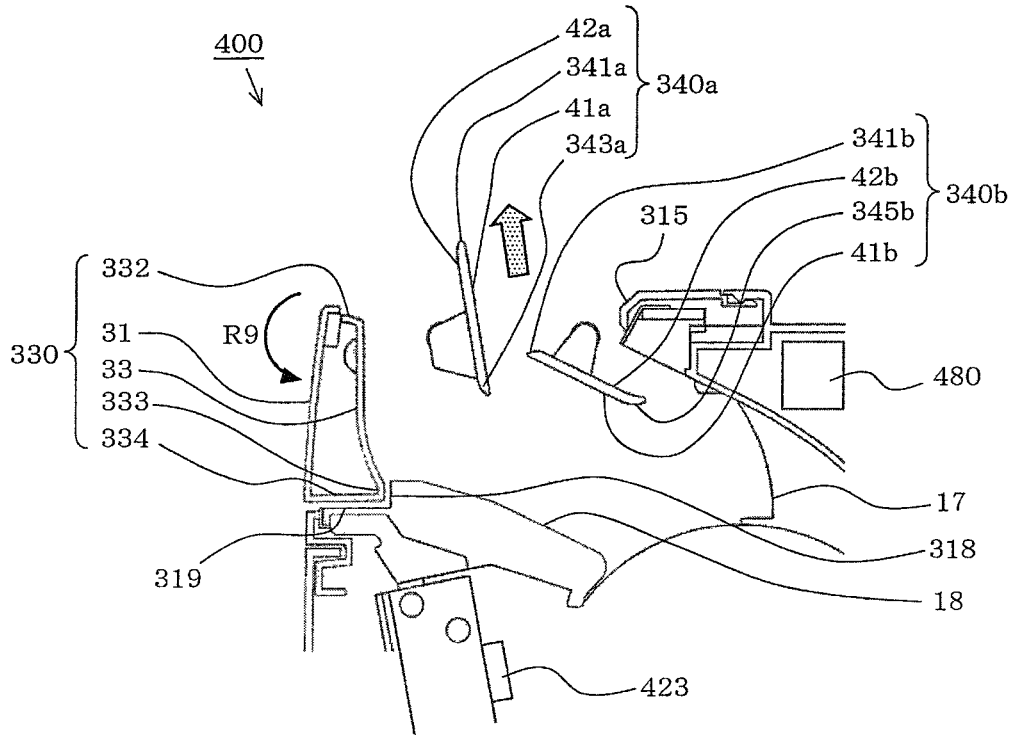
FIG. 21B is a cross-sectional view showing the upward/downward blowing operation posture in a partly enlarged manner for schematically explaining the floor-positioned air-conditioning apparatus according to Embodiment 4 of the invention.
Figure 22:
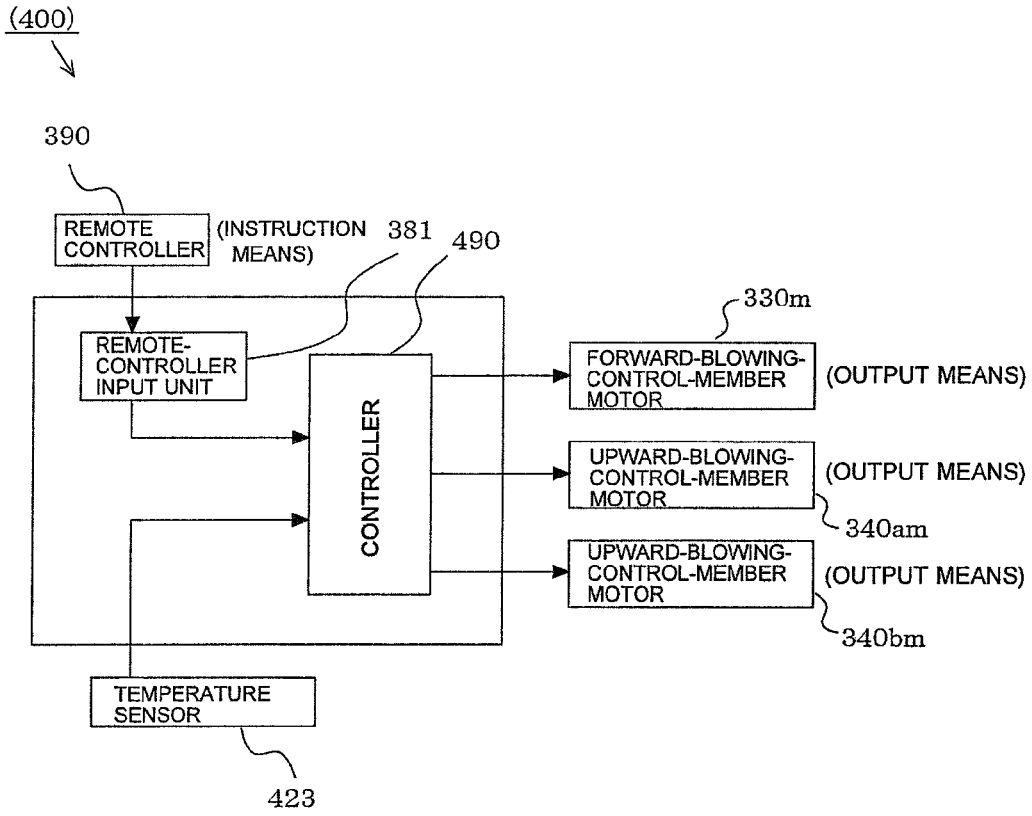
FIG. 22 is a block diagram showing a control system of the floor-positioned air-conditioning apparatus shown in FIG. 21A.
Figure 23:
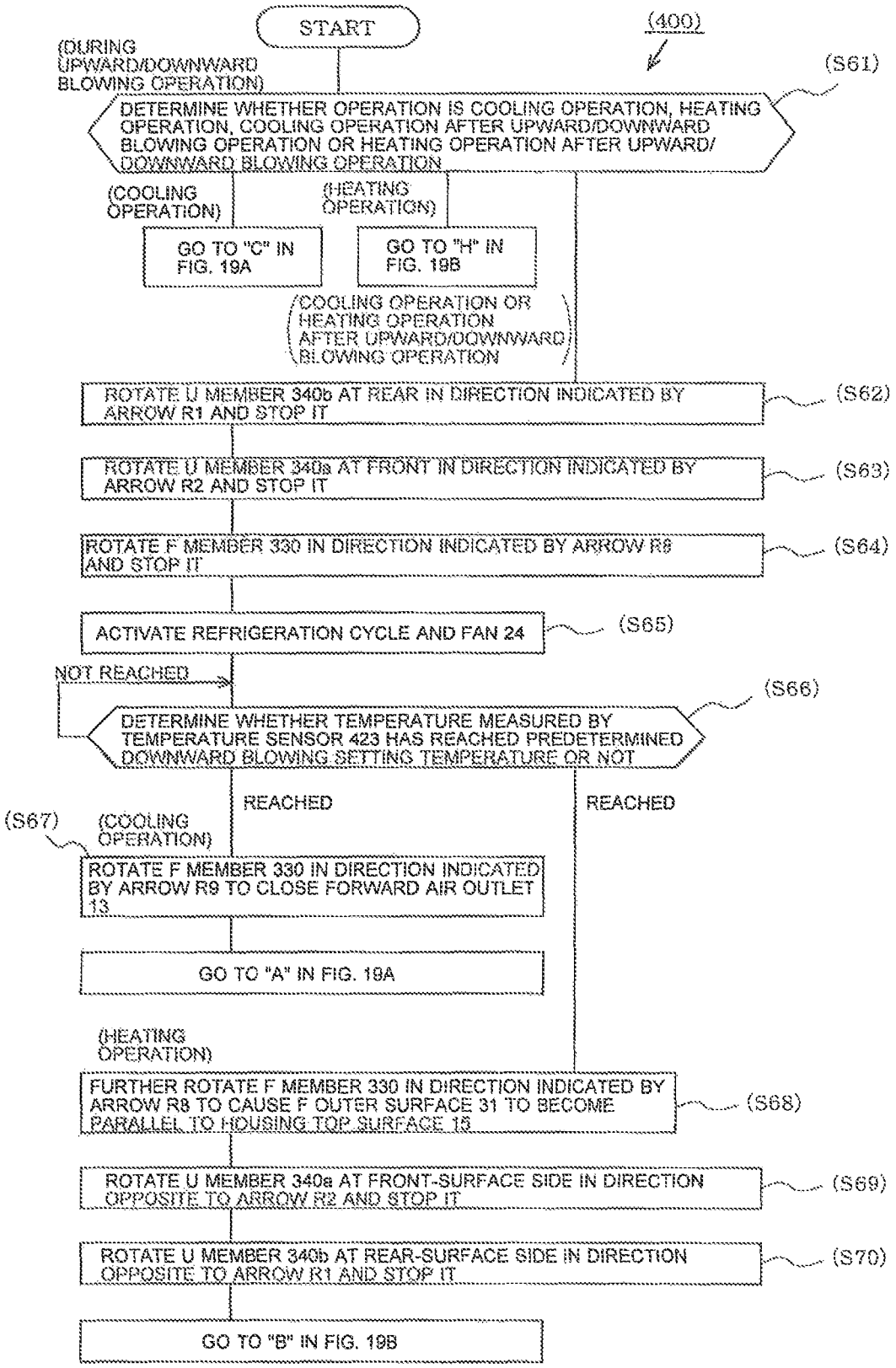
FIG. 23 is a flowchart explaining the control system of the floor-positioned air-conditioning apparatus shown in FIG. 21A.

FIGS. 21A to 23 schematically explain a floor-positioned air-conditioning apparatus according to Embodiment 4 of the invention. FIGS. 21A and 21B are cross-sectional views showing an upward/downward blowing operation posture in a partly enlarged manner. FIG. 22 is a block diagram showing a control system. FIG. 23 is a flowchart explaining the control system. The same reference sign is applied to a portion that is the same as or corresponding to that of Embodiment 3, and explanation is partly omitted. The respective drawings are schematically drawn. The invention is not limited to Embodiment 4.

A floor-positioned air-conditioning apparatus 400 blows conditioned air both upward and forward for a predetermined time at start of heating operation.

That is, conditioned air, which is not sufficiently heated at start of heating operation, is prevented from being blown to a user by the whole quantity, and comfortableness is ensured. Also, at start of cooling operation or start of heating operation, by executing "short circuit" in which part of conditioned air not sufficiently cooled or heated, but cooled or heated by a certain degree, is blown forward and the blown conditioned air is sucked, an increase in temperature or a decrease in temperature of the heat exchanger 23 is promoted.

(During Upward/Downward Blowing Operation)

In FIGS. 21A to 23, the floor-positioned air-conditioning apparatus 400 includes a temperature sensor 423 that measures the temperature of the heat exchanger 23, and a controller 490 that receives input of the measurement result of the temperature sensor 423.

The controller 490 determines whether operation is the cooling operation (upward blowing operation), the heating operation (the downward blowing operation), or the cooling operation (the upward blowing operation) or the heating operation (the downward blowing operation) after the upward/downward operation, in accordance with a signal from the remote controller 390 (S61).

The processing goes to "C" in FIG. 19 in case of the cooling operation (the upward blowing operation), or the processing goes to "H" in FIG. 19 in case of the heating operation (the downward blowing operation), and control in Embodiment 3 is executed (see FIG. 19).

In case of the upward/downward operation and then the cooling operation (the upward blowing operation) or heating operation (the downward blowing operation), first, the U member 340*b* at the rear is rotated in a direction indicated by arrow R1 (counterclockwise in FIG. 21A) and is stopped at a predetermined stop position, to move downward the UF outer arcuate surface 341*b* at the lower side (S62).

Then, the U member 340*a* at the front is rotated in a direction indicated by arrow R2 (clockwise in FIG. 21A) and is stopped at a predetermined stop position, to move downward a UR inclined surface 343*a* at the upper side (S63). That is, the controller 490 emits signals for rotating the upward-blowing-control-member motors 340*am* and 340*bm* in accordance with an operation menu to rotate the U members 340*a* and 340*b* and open the upward air outlet 14.

Then, the F member 330 is rotated in a direction indicated by arrow R8 (clockwise in FIG. 21A) until the posture of the F outer surface 31 becomes a posture facing an obliquely upper side, and is stopped (S64).

Then, the refrigeration cycle and the fan 24 are activated, and the cooling operation or the heating operation is started (S65).

Further, when the temperature measured by the temperature sensor 423 is decreased or increased to a predetermined downward blowing setting temperature (S66), the cooling operation posture or the heating operation posture is taken.

That is, the F member 330 is rotated in a direction indicated by arrow R9 (counterclockwise in FIG. 21B) to press the F inner-surface step portion 333 to the casing step surface 318 and close the forward air outlet 13 (S67). That is, the cooling operation posture (see FIG. 15) is taken. Then, the processing goes to "A" in FIG. 19A, and respective steps in the cooling operation are executed.

If the cooling operation is continued, the operation state of the refrigeration cycle and the fan 24 may not be constant, and is properly controlled.

In contrast, in case of the heating operation, the F member 330 is further rotated in the direction indicated by arrow R8 (clockwise in FIG. 21A) to cause the F outer surface 31 to become parallel to the housing top surface 15 (S68).

Then, a U member 340*a* at the front-surface side is rotated in the direction opposite to arrow R2 (counterclockwise in FIG. 21A) and is stopped (S69). Further, a U member 340*a* at the rear-surface side is rotated in the direction opposite to arrow R1 (clockwise in FIG. 21A) and is stopped (S70). That is, the forward air outlet 13 is closed and the cooling operation posture (see FIG. 15) is taken. Then, the processing goes to "B" in FIG. 19B, and respective steps in the heating operation are executed.

If the heating operation is continued, the operation state of the refrigeration cycle and the fan 24 may not be constant (invariant), and is properly controlled. For example, in an initial phase when the operation is started, the rotation speed of the fan 24 may be occasionally decreased so that the blowing speed of conditioned air becomes relatively low.

Embodiment 5: Floor-positioned Air-conditioning Apparatus

Figure 24:
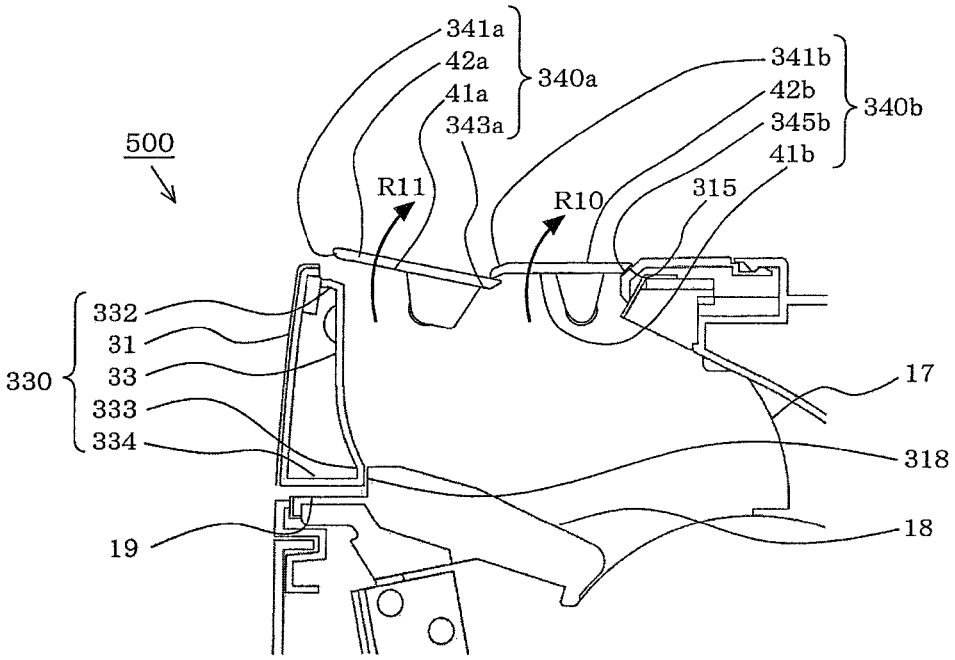
FIG. 24 is a cross-sectional view showing an operation stop posture in a partly enlarged manner for schematically explaining a floor-positioned air-conditioning apparatus according to Embodiment 5 of the invention.
Figure 25:
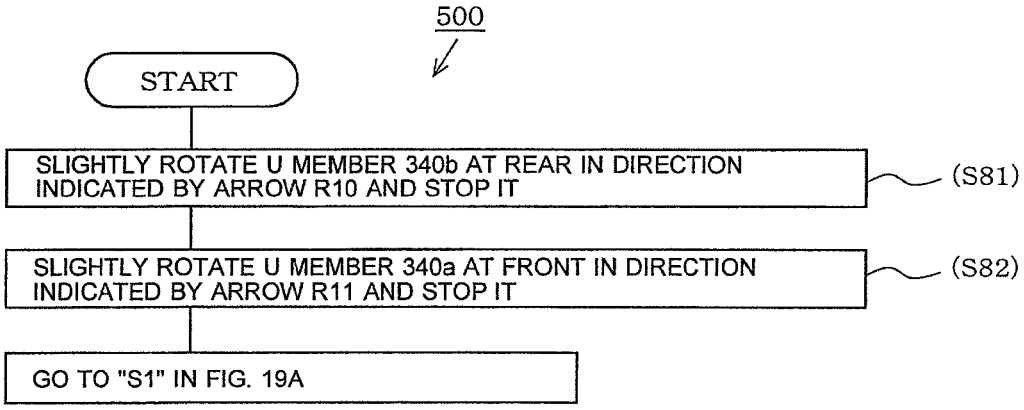
FIG. 25 is a flowchart explaining a control system of the floor-positioned air-conditioning apparatus shown in FIG. 24.

FIGS. 24 and 25 schematically explain a floor-positioned air-conditioning apparatus according to Embodiment 5 of the invention. FIG. 24 is a cross-sectional view showing an operation stop posture in a partly enlarged manner. FIG. 25 is a flowchart explaining a control system. The same reference sign is applied to a portion that is the same as or corresponding to that of Embodiment 3, and explanation is partly omitted. The respective drawings are schematically drawn. The invention is not limited to Embodiment 5.

A floor-positioned air-conditioning apparatus 500 is formed such that, if the UF distal-end surface 343*b* of the U member 340*b* at the rear-surface side contacts the U outer surface 41*a* of the U member 340*a* at the front-surface side by a certain reason (for example, mischief by a child) during operation stop although the UF arcuate surface 341*b* of the U member 340*b* at the rear is originally assumed to contact the UR inclined surface 343*a* of the U member 340*a* at the front-surface side, that is, if the up/down relationship of overlap between both surfaces is inverted, the floor-positioned air-conditioning apparatus 500 can handle the situation.

That is, regardless of whether the up/down relationship of overlap between both surfaces is inverted or not, the U member 340*b* at the rear is slightly rotated in a direction indicated by arrow R10 (clockwise in FIG. 24) and is stopped at a predetermined stop position, to move downward the UF arcuate surface 341*b* at the rear-surface side and the lower side (S81).

Then, the U member 340*a* at the front is slightly rotated in a direction indicated by arrow R11 (clockwise in FIG. 24) and is stopped at a predetermined stop position (S82).

Then, the processing goes to "S1" in FIG. 19A.

If the up/down relationship of overlap between both surfaces is inverted, the U member 340*b* at the rear and the U member 340*a* at the front are actually rotated in step S81 and step S82. Accordingly, the U member 340*b* at the rear becomes rotatable.

In contrast, if the up/down relationship of overlap between both surfaces is the original relationship, the U member 340*b* at the rear or the U member 340*a* at the front is not rotated in step S81 or step S82, and the posture during operation stop is held (because the upward-blowing-control-member motors 40*am* and 40*bm* slide). At this time, the U member 340*b* at the rear becomes rotatable.

Hence, with the floor-positioned air-conditioning apparatus 500, even if the partial overlap condition of the U member 340*a* at the front-surface side and the U member 340*b* at the rear-surface side is inverted, the cooling operation and the heating operation similar to those of the floor-positioned air-conditioning apparatus 300 can be executed. Further, the operation control can be applied to the floor-positioned air-conditioning apparatus 400.

Embodiment 6: Floor-positioned Air-conditioning Apparatus

Figure 26A:
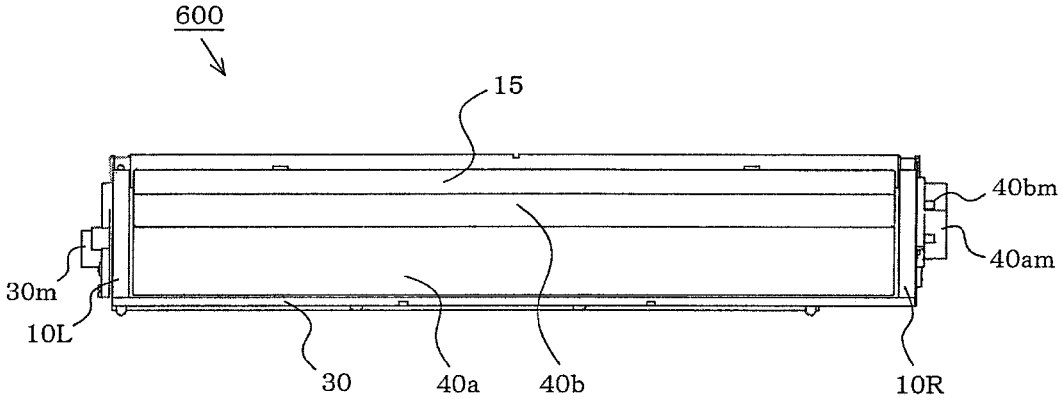
FIG. 26A is a top view schematically explaining a floor-positioned air-conditioning apparatus according to Embodiment 6 of the invention.
Figure 26B:
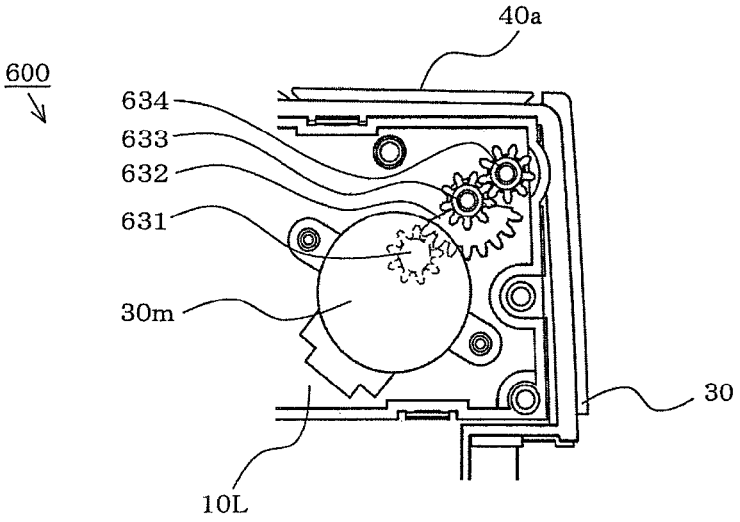
FIG. 26B is a left side view with a side-surface cover of a housing of the floor-positioned air-conditioning apparatus shown in FIG. 26A illustrated in a perspective manner.
Figure 26C:
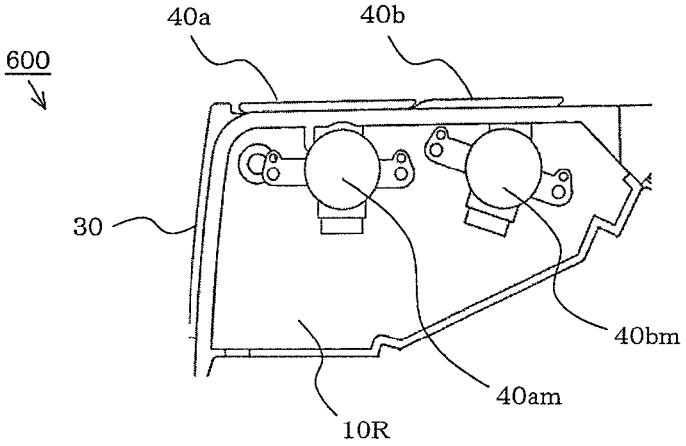
FIG. 26C is a right side view with a side-surface cover of the housing of the floor-positioned air-conditioning apparatus shown in FIG. 26A illustrated in a perspective manner.

FIGS. 26A to 26C schematically explain a floor-positioned air-conditioning apparatus according to Embodiment 6 of the invention. FIG. 26A is a top view. FIG. 26B is a left side view with a side surface cover of a housing illustrated in a perspective manner. FIG. 26C is a right side view with a side surface cover of the housing illustrated in a perspective manner. The same reference sign is applied to a portion that is the same as or corresponding to that of Embodiment 1, and explanation is partly omitted. The respective drawings are schematically drawn. The invention is not limited to Embodiment 6.

In FIGS. 26A to 26C, in a floor-positioned air-conditioning apparatus 600, the forward-blowing-control-member motor 30*m* that rotates the forward blowing control member 30 is provided at a housing left member 10L arranged at a left-side-surface side of the housing 10; and the upward-blowing-control-member motor 40*am* and the upward-blowing-control-member motor 40*bm* that rotate the upward blowing control member 40*a* and the upward blowing control member 40*b*, respectively, are provided at a housing right member 10R arranged at the right-side-surface side of the housing 10.

Hence, the forward-blowing-control-member motor 30*m* does not interfere with the upward-blowing-control-member motors 40*am* and 40*bm*.

Further, rotation of a pinion (not shown) fixed to a rotation axis of the forward-blowing-control-member motor 30*m* is successively transmitted to pinions 631, 632, 633, and 664 that are rotatably provided at the housing left member 10L. Herein, the number of teeth of the pinion 632 is larger than the number of teeth of the pinion 631, the pinion 632 and the pinion 633 have a common rotation axis and are integrally rotated, and the pinion 634 is fixed to the forward-blowing-control-member support 34. Accordingly, the rotation of the forward-blowing-control-member motor 30*m* is transmitted to the forward-blowing-control-member support 34 in a speed-reduced state.

Accordingly, the degree of freedom of the position at which the forward-blowing-control-member motor 30*m* is arranged is increased, and the forward blowing control member 30 is reliably rotated even if the forward-blowing-control-member motor 30*m* is small with a relatively small torque. Hence, the weight and manufacturing cost of the floor-positioned air-conditioning apparatus 600 can be reduced.

The invention claimed is:

1. A floor-positioned air-conditioning apparatus comprising:

a housing including a fan and a heat exchanger that can selectively execute a cooling operation and a heating operation; a forward blowing control member rotatably arranged at a forward air outlet formed in a front surface of the housing at a position near a top surface of the housing; and an upward blowing control member rotatably arranged at an upward air outlet formed in the top surface of the housing at a position near the front surface of the housing, wherein the forward blowing control member closes the forward air outlet and the upward blowing control member closes the upward air outlet during operation stop, the forward blowing control member closes the forward air outlet and the upward blowing control member is rotated and opens the upward air outlet during cooling operation, the upward blowing control member closes the upward air outlet and the forward blowing control member is rotated and opens the forward air outlet during heating operation, and the forward blowing control member includes a forward-blowing-control-member outer surface that forms a surface continued to the front surface of the housing during operation stop, and a forward-blowing-control-member inner surface that gradually extends to elongate in a direction away from the forward-blowing-control-member outer surface, the forward-blowing-control-member inner surface and the forward-blowing-control-member outer surface form opposite surfaces of the forward blowing control members, the upward blowing control member is formed of an upward blowing control member arranged at a front-surface side and an upward blowing control member arranged at a rear-surface side, an upward-blowing-control-member rear-end inclined surface is formed at an end portion at the rear-surface side of the upward blowing control member arranged at the front-surface side of the upward blowing control member during operation stop, an upward-blowing-control-member inner-surface front-end arcuate surface is formed at an end portion at the front-surface side of the upward blowing control member arranged at the rear-surface side of the upward blowing control member during operation stop, the upward-blowing-control-member rear-end inclined surface overlaps the upward-blowing-control-member inner-surface front-end arcuate surface during operation stop, and in any situation of start of the cooling operation and start of the heating operation, the upward blowing control member arranged at the rear-surface side is rotated in a direction in which the upward-blowing-control-member inner-surface front-end arcuate surface moves toward the inside of the housing, and then the upward blowing control member arranged at the front-surface side is rotated in a direction in which the upward-blowing-control-member rear-end inclined surface moves toward the outside of the housing.

2. The floor-positioned air-conditioning apparatus of claim 1, wherein the upward blowing control member includes an upward-blowing-control-member outer surface forming a surface continued to the top surface of the housing during operation stop, and an upward-blowing-control-member inner surface being parallel to the upward-blowing-control-member outer surface, wherein the forward blowing control member is rotated and the forward-blowing-control-member outer surface becomes substantially parallel to the upward-blowing-control-member inner surface during heating operation, and wherein the upward blowing control member is rotated and the upward-blowing-control-member outer surface is brought into a posture being substantially parallel to the forward-blowing-control-member outer surface or a posture being inclined only by a predetermined angle during cooling operation.

3. The floor-positioned air-conditioning apparatus of claim 2, wherein a forward-blowing-control-member support is provided at the forward-blowing-control-member inner surface, and the forward blowing control member is rotated about the forward-blowing-control-member support, and wherein a protruding upward-blowing-control-plate arm is provided at the upward-blowing-control-member inner surface, an upward-blowing-control-member support is provided at the upward-blowing-control-plate arm, and the upward blowing control member is rotated about the upward-blowing-control-member support.

4. The floor-positioned air-conditioning apparatus of claim 2, wherein, when the forward blowing control member is rotated, the upward blowing control member is rotated in advance in a direction in which the upward-blowing-control-member inner surface is retracted from the forward blowing control member, and after the forward blowing control member is rotated, the upward blowing control member is rotated in a direction in which the upward-blowing-control-member inner surface approaches the forward blowing control member.

5. The floor-positioned air-conditioning apparatus of claim 1, wherein a forward-blowing-control-member top-surface step portion is formed at an upper end surface of the forward blowing control member during operation stop, and wherein the upward-blowing-control-member front-end arcuate surface overlaps the forward-blowing-control-member top-surface step portion during operation stop.

6. The floor-positioned air-conditioning apparatus of claim 1, wherein a plurality of recessed grooves are formed at a surface at a housing side of the upward blowing control member during operation stop.

7. The floor-positioned air-conditioning apparatus of claim 1, wherein a plurality of projections and depressions are formed at a lower end surface of the forward blowing control member during operation stop.

8. The floor-positioned air-conditioning apparatus of claim 1, wherein the forward blowing control member is hollow, and a heat insulator is provided in the forward blowing control member.

9. The floor-positioned air-conditioning apparatus of claim 1, wherein a forward-blowing-control-member motor that rotates the forward blowing control member is provided near one side surface of the housing, and an upward-blowing- control-member motor that rotates the upward blowing control member is provided near the other side surface of the housing, and wherein rotation of the forward-blowing-control-member motor is transmitted to the forward blowing control member through a speed reduction mechanism.

10. The floor-positioned air-conditioning apparatus of claim 3, wherein, when the forward blowing control member is rotated, the upward blowing control member is rotated in advance in a direction in which the upward-blowing-control-member inner surface is retracted from the forward blowing control member, and after the forward blowing control member is rotated, the upward blowing control member is rotated in a direction in which the upward-blowing-control-member inner surface approaches the forward blowing control member.

11. The floor-positioned air-conditioning apparatus of claim 1, wherein a housing top-surface inclined surface is formed at a top surface of the housing, and wherein the upward-blowing-control-member rear-end inclined surface overlaps the housing top-surface inclined surface during operation stop.

12. The floor-positioned air-conditioning apparatus of claim 1, wherein a forward-blowing-control-member top-surface step portion is formed at an upper end surface of the forward blowing control member during operation stop, and wherein the upward-blowing-control-member front-end arcuate surface overlaps the forward-blowing-control-member top-surface step portion during operation stop.

13. A floor-positioned air-conditioning apparatus comprising:

a housing including a fan and a heat exchanger that can selectively execute a cooling operation and a heating operation; a forward blowing control member rotatably arranged at a forward air outlet formed in a front surface of the housing at a position near a top surface of the housing; and an upward blowing control member rotatably arranged at an upward air outlet formed in the top surface of the housing at a position near the front surface of the housing, wherein the forward blowing control member closes the forward air outlet and the upward blowing control member closes the upward air outlet during operation stop, the forward blowing control member closes the forward air outlet and the upward blowing control member is rotated and opens the upward air outlet during cooling operation, the upward blowing control member closes the upward air outlet and the forward blowing control member is rotated and opens the forward air outlet during heating operation, and the forward blowing control member includes a forward-blowing-control-member outer surface that forms a surface continued to the front surface of the housing during operation stop, and a forward-blowing-control-member inner surface that gradually extends to elongate in a direction away from the forward-blowing-control-member outer surface, the forward-blowing-control-member inner surface and the forward-blowing-control-member outer surface form opposite surfaces of the forward blowing control members, the upward blowing control member is formed of an upward blowing control member arranged at a front-surface side and an upward blowing control member arranged at a rear-surface side, an upward-blowing-control-member rear-end inclined surface is formed at an end portion at the rear-surface side of the upward blowing control member arranged at the front-surface side of the upward blowing control member during operation stop, an upward-blowing-control-member inner-surface front-end arcuate surface is formed at an end portion at the front-surface side of the upward blowing control member arranged at the rear-surface side of the upward blowing control member during operation stop, the upward-blowing-control-member rear-end inclined surface overlaps the upward-blowing-control-member inner-surface front-end arcuate surface during operation stop, in any situation of start of the cooling operation and start of the heating operation, the upward blowing control member arranged at the rear-surface side is rotated in a direction in which the upward-blowing-control-member inner-surface front-end arcuate surface moves toward the inside of the housing, and then the upward blowing control member arranged at the front-surface side is rotated in a direction in which the upward-blowing-control-member rear-end inclined surface moves toward the outside of the housing, a housing top-surface inclined surface is formed at a top surface of the housing, and the upward-blowing-control-member rear-end inclined surface overlaps the housing top-surface inclined surface during operation stop.

14. A floor-positioned air-conditioning apparatus comprising:

a housing including a fan and a heat exchanger that can selectively execute a cooling operation and a heating operation; a forward blowing control member rotatably arranged at a forward air outlet formed in a front surface of the housing at a position near a top surface of the housing; and an upward blowing control member rotatably arranged at an upward air outlet formed in the top surface of the housing at a position near the front surface of the housing, wherein the forward blowing control member closes the forward air outlet and the upward blowing control member closes the upward air outlet during operation stop, the forward blowing control member closes the forward air outlet and the upward blowing control member is rotated and opens the upward air outlet during cooling operation, the upward blowing control member closes the upward air outlet and the forward blowing control member is rotated and opens the forward air outlet during heating operation, and the forward blowing control member includes a forward-blowing-control-member outer surface that forms a surface continued to the front surface of the housing during operation stop, and a forward-blowing-control-member inner surface that gradually extends to elongate in a direction away from the forward-blowing-control-member outer surface, the forward-blowing-control-member inner surface and the forward-blowing-control-member outer surface form opposite surfaces of the forward blowing control members, the upward blowing control member includes an upward-blowing-control-member outer surface forming a surface continued to the top surface of the housing during operation stop, and an upward-blowing-control-member inner surface being parallel to the upward-blowing-control-member outer surface, the forward blowing control member is rotated and the forward-blowing-control-member outer surface becomes substantially parallel to the upward-blowing-control-member inner surface during heating operation, and the upward blowing control member is rotated and the upward-blowing-control-member outer surface is brought into a posture being substantially parallel to the forward-blowing-control-member outer surface or a posture being inclined only by a predetermined angle during cooling operation, the upward blowing control member is formed of an upward blowing control member arranged at a front-surface side and an upward blowing control member arranged at a rear-surface side, an upward-blowing-control-member rear-end inclined surface is formed at an end portion at the rear-surface side of the upward blowing control member arranged at the front-surface side of the upward blowing control member during operation stop, an upward-blowing-control-member inner-surface front-end arcuate surface is formed at an end portion at the front-surface side of the upward blowing control member arranged at the rear-surface side of the upward blowing control member during operation stop, the upward-blowing-control-member rear-end inclined surface overlaps the upward-blowing-control-member inner-surface front-end arcuate surface during operation stop, and in any situation of start of the cooling operation and start of the heating operation, the upward blowing control member arranged at the rear-surface side is rotated in a direction in which the upward-blowing-control-member inner-surface front-end arcuate surface moves toward the inside of the housing, and then the upward blowing control member arranged at the front-surface side is rotated in a direction in which the upward-blowing-control-member rear-end inclined surface moves toward the outside of the housing.

* * * * *